US011551508B2

(12) United States Patent
Marks et al.

(10) Patent No.: US 11,551,508 B2
(45) Date of Patent: Jan. 10, 2023

(54) SYSTEM AND METHOD OF PROVIDING A HOLD AND SPIN FEATURE GAME WITH ITERATIVE AWARDS

(71) Applicant: Aristocrat Technologies, Inc. (ATI), Las Vegas, NV (US)

(72) Inventors: Daniel Marks, Decatur, GA (US); Hua Xu, Marietta, GA (US)

(73) Assignee: Aristocrat Technologies, Inc. (ATI), Las Vegas, NV (US)

( * ) Notice: Subject to any disclaimer, the term of this patent is extended or adjusted under 35 U.S.C. 154(b) by 316 days.

(21) Appl. No.: 16/780,839

(22) Filed: Feb. 3, 2020

(65) Prior Publication Data

US 2021/0241572 A1 Aug. 5, 2021

(51) Int. Cl.
*G07F 17/32* (2006.01)

(52) U.S. Cl.
CPC ..... *G07F 17/3213* (2013.01); *G07F 17/3244* (2013.01)

(58) Field of Classification Search
CPC ..... G07F 17/326; G07F 17/3267
See application file for complete search history.

(56) References Cited

U.S. PATENT DOCUMENTS

| | | | |
|---|---|---|---|
| 7,070,501 | B2 | 7/2006 | Cormack et al. |
| 8,360,851 | B2 | 1/2013 | Aoki et al. |
| 9,424,720 | B2 | 8/2016 | Suda |
| 9,928,691 | B2 | 3/2018 | Olive |
| 2003/0216165 | A1 | 11/2003 | Singer et al. |
| 2004/0137982 | A1 | 7/2004 | Cuddy et al. |
| 2006/0189369 | A1 | 8/2006 | Taylor |
| 2007/0060248 | A1 | 3/2007 | Rodgers et al. |
| 2009/0054129 | A1 | 2/2009 | Yoshimura et al. |
| 2009/0239634 | A1 | 9/2009 | Nguyen |

(Continued)

FOREIGN PATENT DOCUMENTS

| | | |
|---|---|---|
| AU | 2013202658 | 1/2014 |
| AU | 2013251288 | 5/2014 |

(Continued)

OTHER PUBLICATIONS

Australian Examination Report for AU2016100230, dated May 11, 2016. (5 pages).

(Continued)

*Primary Examiner* — Milap Shah
*Assistant Examiner* — Jason Pinheiro
(74) *Attorney, Agent, or Firm* — McAndrews, Held & Malloy, Ltd.

(57) ABSTRACT

A gaming machine provides a spinning reel game having a base game, from which a hold and spin feature game is triggered when a determined number of configurable symbols are displayed in a base game outcome. When the feature game is triggered, the configurable symbols are held in place on the display and the player is provided one or more spins during the feature game in which to collect additional configurable symbols. Any additional configurable symbols are retained on the display during subsequent spins until the feature game is completed. For each spin that includes additional configurable symbols, one or more awards are determined in an iterative manner that includes award values from any configurable symbols in the previous outcomes.

20 Claims, 32 Drawing Sheets

(56) References Cited

U.S. PATENT DOCUMENTS

| | | | | |
|---|---|---|---|---|
| 2010/0075737 | A1 | 3/2010 | Bluemel | |
| 2010/0210343 | A1 | 8/2010 | Englman et al. | |
| 2010/0234092 | A1 | 9/2010 | Gomez et al. | |
| 2012/0178517 | A1 | 7/2012 | Montenegro et al. | |
| 2013/0331168 | A1 | 12/2013 | Street | |
| 2014/0274292 | A1 | 9/2014 | Suda | |
| 2014/0323198 | A1 | 10/2014 | Tuck | |
| 2015/0310699 | A1 | 10/2015 | Meyer | |
| 2016/0042597 | A1* | 2/2016 | Olive | G07F 17/3267 463/21 |
| 2016/0253873 | A1 | 9/2016 | Olive | |
| 2017/0148274 | A1 | 5/2017 | Olive | |
| 2017/0154498 | A1 | 6/2017 | Olive | |
| 2018/0268655 | A1 | 9/2018 | Olive | |

FOREIGN PATENT DOCUMENTS

| | | |
|---|---|---|
| AU | 2014202042 | 5/2014 |
| EP | 0984408 | 3/2000 |

OTHER PUBLICATIONS

Australian Examination Report for AU2015210489, dated Jun. 14, 2016. (5 pages).

Australian Examination Report for AU2016202727, dated Jul. 4, 2016. (5 pages).

Australian Examination Report for 2017101097, dated Dec. 7, 2017. (3 pages).

Australian Examination Report for AU2017101629, dated Jan. 16, 2018. (3 pages).

Australian Examination Report for AU2017204560, dated Feb. 1, 2018. (3 pages).

Australian Examination Report for AU2018278882, dated Dec. 9, 2019. (2 pages).

Konami All Aboard at https://www.youtube.com/watch?v=TWYdFMBIJRs (Video), last accessed Feb. 3, 2020.

All Aboard The Drop Test Drives at https://the-drop.com.au/the-drop-test-drives-komanis-all-aboard-hit-games/.

* cited by examiner

1126

1132

SYSTEM AND METHOD OF PROVIDING A HOLD AND SPIN FEATURE GAME WITH ITERATIVE AWARDS

BACKGROUND

Electronic gaming machines ("EGMs") or gaming devices provide a variety of wagering games such as slot games, video poker games, video blackjack games, roulette games, video bingo games, keno games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical wagering games use a random number generator (RNG) to randomly determine the outcome of each game. The wagering game is designed to return a certain percentage of the amount wagered back to the player (RTP=return to player) over the course of many plays or instances of the game. The RTP and randomness of the RNG are critical to ensuring the fairness of the games and are, therefore, highly regulated. Upon initiation of play, the RNG randomly determines a game outcome and symbols are then selected which correspond to that outcome. Notably, some games may include an element of skill on the part of the player and are, therefore, not entirely random.

In existing gaming systems, feature games, secondary or bonus games, may be triggered for players in addition to the base game. A feature game gives players an additional opportunity to win prizes, or the opportunity to win larger prizes, than would otherwise be available in the base game. Feature games can also offer altered game play to enhance player enjoyment.

The popularity of such gaming machines with players is heavily dependent on the entertainment value of the machine relative to other gaming options and the player's gambling experience. Operators of gaming businesses therefore strive to provide the most entertaining, engaging, and exciting machines to attract customers to use the machines while also providing a machine that allows the player to enjoy their gambling experience. Accordingly, there is a continuing need for gaming machine manufacturers to develop new games in order to maintain or increase player enjoyment.

SUMMARY

Embodiments provide a gaming device, a method and gaming system with a spinning reel game having a base game, from which a hold and spin feature game is triggered when a determined number of configurable symbols are displayed in a base game outcome. When the feature game is triggered, the configurable symbols are held in place on the display and the player is provided one or more spins during the feature game in which to collect additional configurable symbols. Any additional configurable symbols are retained on the display during subsequent spins until the feature game is completed. For each spin that includes additional configurable symbols, one or more awards are determined in an iterative manner that includes award values from any configurable symbols in the previous outcomes.

An embodiment provides a gaming device comprising a player interface; a display system comprising one or more display devices; and a control system comprising one or more processors; the control system executing instructions which cause the control system to determine a base game outcome and corresponding display symbols, the display symbols selected from a base game symbol set; control the display system to present the base game outcome; determine that a feature game trigger condition exists when the base game outcome comprises at least a quantity of trigger symbols; control the display system to present a feature game having a first quantity of instances; and for each instance of the feature game, determine an outcome and corresponding display symbols for the instance, the display symbols selected from a feature game symbol set comprising configurable symbols and non-configurable symbols; control the display system to hold each displayed configurable symbol at its corresponding display symbol position for any remaining instance of the feature game; and in response to determining that the outcome for the instance includes at least two additional configurable symbols, determine a first award amount and a second award amount, the first award amount based on values of the configurable symbols held from previous instances, the second award amount based on the first award amount and a first of the at least two additional configurable symbols.

An embodiment provides a method of operating a gaming device comprising determining, by a controller, a base game outcome and corresponding display symbols, the display symbols selected from a base game symbol set; presenting, via a display device, the base game outcome; determining, by the controller, that a feature game trigger condition exists when the base game outcome comprises at least a quantity of trigger symbols; presenting, via the display device, a feature game having a first quantity of instances, and for each instance of the feature game; determining an outcome and corresponding display symbols for the instance, the display symbols selected from a feature game symbol set comprising configurable symbols and non-configurable symbols; holding each displayed configurable symbol at its corresponding display symbol position for any remaining instance of the feature game, and in response to determining that the outcome for the instance includes at least two additional configurable symbols; determining a first award amount and a second award amount, the first award amount based on values of the configurable symbols held from previous instances, the second award amount based on the first award amount and a first of the at least two additional configurable symbols.

Another embodiment provides one or more non-transitory media having software stored thereon, the software including instructions for controlling one or more devices to perform a method, the method comprising determining, by a controller, a base game outcome and corresponding display symbols, the display symbols selected from a base game symbol set, presenting, via a display device, the base game outcome; determining, by the controller, that a feature game trigger condition exists when the base game outcome comprises at least a quantity of trigger symbols; presenting, via the display device, a feature game having a first quantity of instances; and for each instance of the feature game, determining an outcome and corresponding display symbols for the instance, the display symbols selected from a feature game symbol set comprising configurable symbols and non-configurable symbols; holding each displayed configurable symbol at its corresponding display symbol position for any remaining instance of the feature game; and in response to determining that the outcome for the instance includes at least two additional configurable symbols, determining a first award amount and a second award amount, the first award amount based on values of the configurable symbols held from previous instances, the second award amount based on the first award amount and a first of the at least two additional configurable symbols.

BRIEF DESCRIPTION OF THE DRAWINGS

Features and advantages of certain embodiments of the present disclosure will become apparent from the following description of embodiments thereof, by way of example only, with reference to the accompanying drawings, in which.

Figure 1:
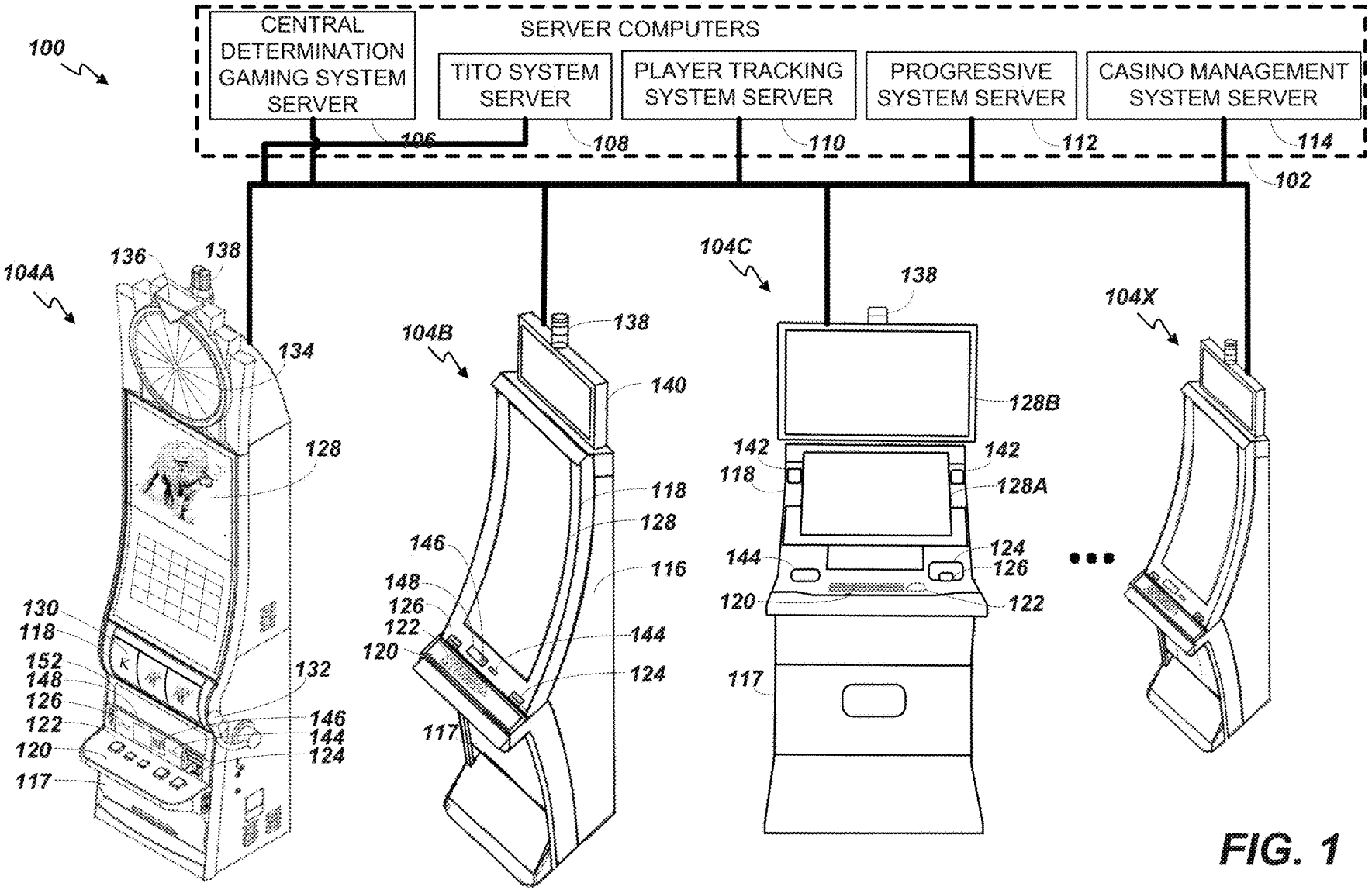
FIG. 1 is an example diagram showing several EGMs networked with various gaming-related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present invention is not limited to the arrangements and instrumentality shown in the attached drawings.

DETAILED DESCRIPTION

The present disclosure is generally directed to a hold and spin feature game in which an award is provided after each spin or instance of the feature game that includes at least one additional What you See is What you Get (WYSIWYG) symbol. If there are multiple WYSIWYG symbols in an instance of the feature game, then multiple iterative awards are provided for that spin. The first of the iterative award may include values from the WYSIWYG symbols held from the previous spin whereas the second iterative award may include values from the WYSIWYG symbols held from the previous spin plus one of the additional WYSIWYG symbols.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a web site maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the server computers 102 described herein.

Moreover, in some implementations at least some of the EGMs may be "thin-client" or "thick-client" EGMs that are not configured for stand-alone determination of game outcomes, etc. Such client EGMs may be configured for communication with one or more of the different server computers 102 described herein, including but not limited to the central determination gaming system server 106. Some such client EGMs may, for example, be configured to accept tickets and/or cash (e.g., via a bill validator that also functions as a ticket reader) to load credits onto the client EGM, a "ticket-out" printer for outputting a credit ticket when a cash out button is pressed, a player tracking card reader, etc. Some client EGMs may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client EGM may include a display system, an audio system, etc., for presenting attract sequences, game presentations, etc. The game presentations may include game outcomes determined by another device, such as the central determination gaming system server 106.

The server computers 102 also may include a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over a network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 127 which may be used to determine an outcome to the game.

In many configurations, the gaming device 104A may have a main display 128 (e.g., video display monitor) mounted to, or above, the gaming display area 127. The main display 128 can be, e.g., a high-resolution LCD, plasma, LED, or OLED panel which may be flat or curved as shown, a cathode ray tube, or other conventional electronically controlled video monitor. The main display 128 may be of one or more various orientations (i.e., landscape or portrait), aspect ratios and resolutions. In some implementations, the main display 128 may include a touchscreen.

In some embodiments, the bill validator 124 may also function as a "ticket-in" reader that allows the player to use a casino-issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems may be used to generate and track unique bar-codes or other indicators printed on tickets to allow players to avoid the use of bills and coins by loading credits using a ticket reader and cashing out credits using a ticket-out printer 126 on the gaming device 104A. The gaming device 104A may have hardware meters for purposes including ensuring regulatory compliance and monitoring the player credit balance. In addition, there can be additional meters that record the total amount of money wagered on the gaming machine, total amount of money deposited, total amount of money withdrawn, and total amount of winnings on gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in the EGM 104A. In such embodiments, a game controller (not shown in FIG. 1) within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2A:
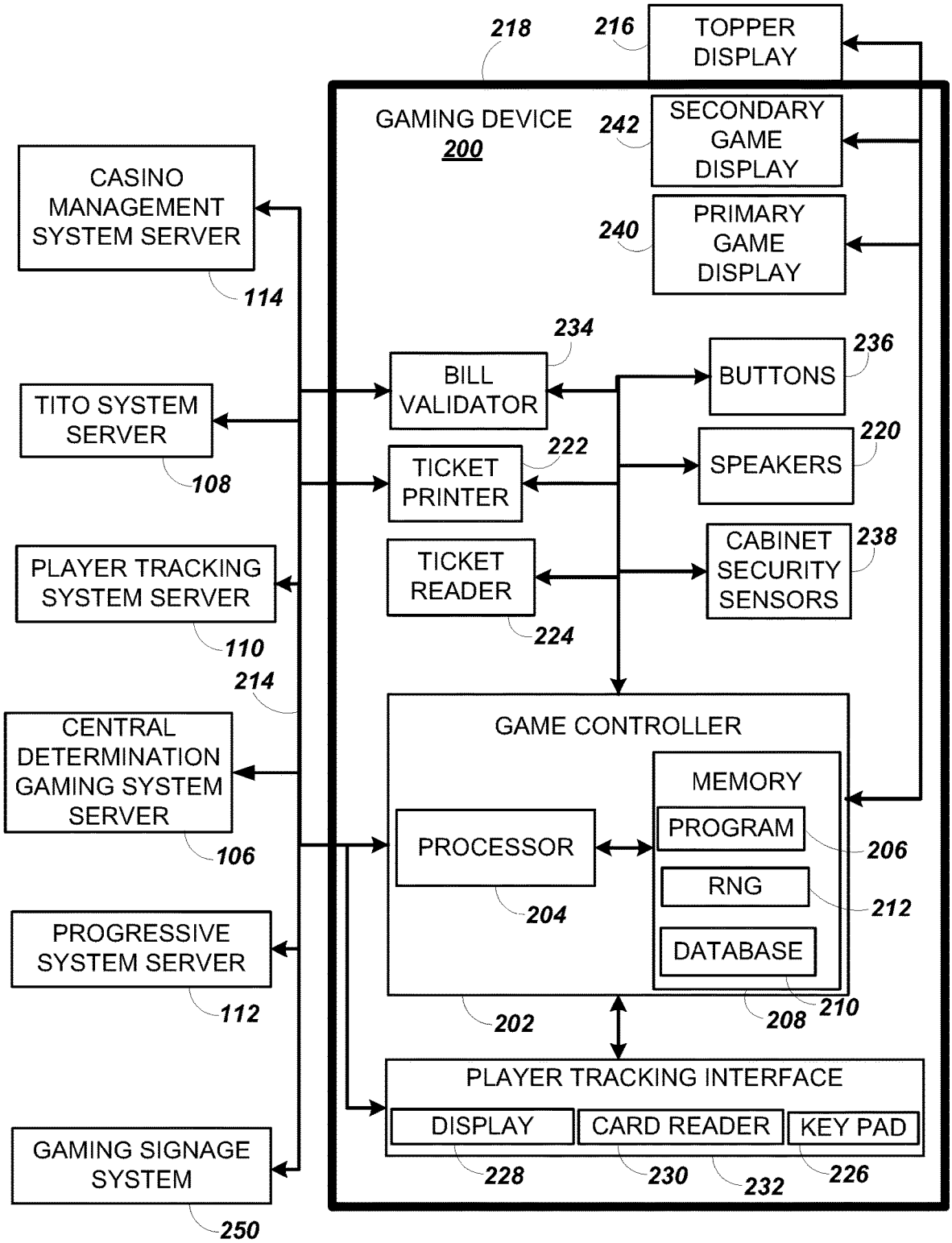
FIG. 2A is a block diagram showing various functional elements of an example EGM.

Many or all of the above-described components can be controlled by circuitry (e.g., a gaming controller) housed inside the main cabinet 116 of the gaming device 104A, the details of which are shown in FIG. 2A.

Note that not all gaming devices that are suitable for implementing embodiments of the present disclosure necessarily include top wheels, top boxes, information panels, cashless ticket systems, and/or player tracking systems. Further, some suitable gaming devices may have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that, where possible, reference numerals identifying similar features of the gaming device 104A embodiment are also identified in the gaming device 104B embodiment using the same reference numbers. Gaming device 104B does not include physical reels, but instead shows game play functions on main display 128. An optional topper screen 140 may be used as a secondary game display for bonus play to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape-style main display 128A may have a curvature radius from top to bottom, or alternatively, from side to side. In some embodiments, main display 128A is a flat panel display. Main display 128A is typically used for primary game play while secondary display 128B is typically used for a bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black-jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2A is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (a play or round of the game) may be generated on a remote gaming device such as the central determination gaming system server 106 (not shown in FIG. 2A but shown in FIG. 1). The game instance may be communicated to gaming device 200 via the network 214 and then displayed on gaming device 200. Gaming device 200 may execute game software, such as, but not limited to, video streaming software that allows the game to be displayed on gaming device 200. When a game is stored on gaming device 200, it may be loaded from the memory 208 (e.g., from a read only memory (ROM)) or from the central determination gaming system server 106 to memory 208. The memory 208 may include random access memory (RAM), ROM or another form of storage media that stores instructions for execution by the processor 204.

The gaming device 200 may include a topper display 216 or another form of a top box (e.g., a topper wheel, a topper screen, etc.) which sits above main cabinet 218. The cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Some gaming devices, such as gaming devices 104A-104X, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming device 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player can view the game outcome on the primary game display 240 and/or the secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using a player interface system, which may include the player input buttons 236, the primary game display 240 (which may include a touch screen), or some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

In this example, the gaming device 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance (typically by pressing a cash-out button to receive a ticket from the ticket printer 222). The ticket may be redeemed for money or inserted into another machine to establish a credit balance for play.

While an example gaming device 200 has been described in regard to FIG. 2A, certain aspects of the present disclosure may be implemented by gaming devices that lack one or more of the above-described components. For example, not all gaming devices suitable for implementing aspects of the present disclosure necessarily include top boxes, information panels, cashless ticket systems, and/or player tracking systems. Further, some suitable gaming devices may include a single game display having mechanical reels or a video display. Moreover, other embodiments may be designed for bar tables and have displays that face upwards.

Many different types of wagering games, including mechanical slot games, video slot games, video poker, video black-jack, video pachinko, keno, bingo, and lottery, may be provided by the gaming device 200. In particular, the gaming device 200 may be operable to provide many different instances of games of chance. The instances may be differentiated according to themes, sounds, graphics, type of game (e.g., slot game vs. card game vs. game with aspects of skill), denomination, number of paylines, maximum jackpot, progressive or non-progressive, bonus games, class 2 or class 3, etc.

The gaming device 200 may allow a player to select a game of chance, skill, or combination thereof, to play from a plurality of instances available on the gaming device 200. For example, the gaming device 200 may provide a menu with a list of the instances of games that are available for play on the gaming device 200 and a player may be able to select, from the list, a game that they wish to play.

Figure 2B:
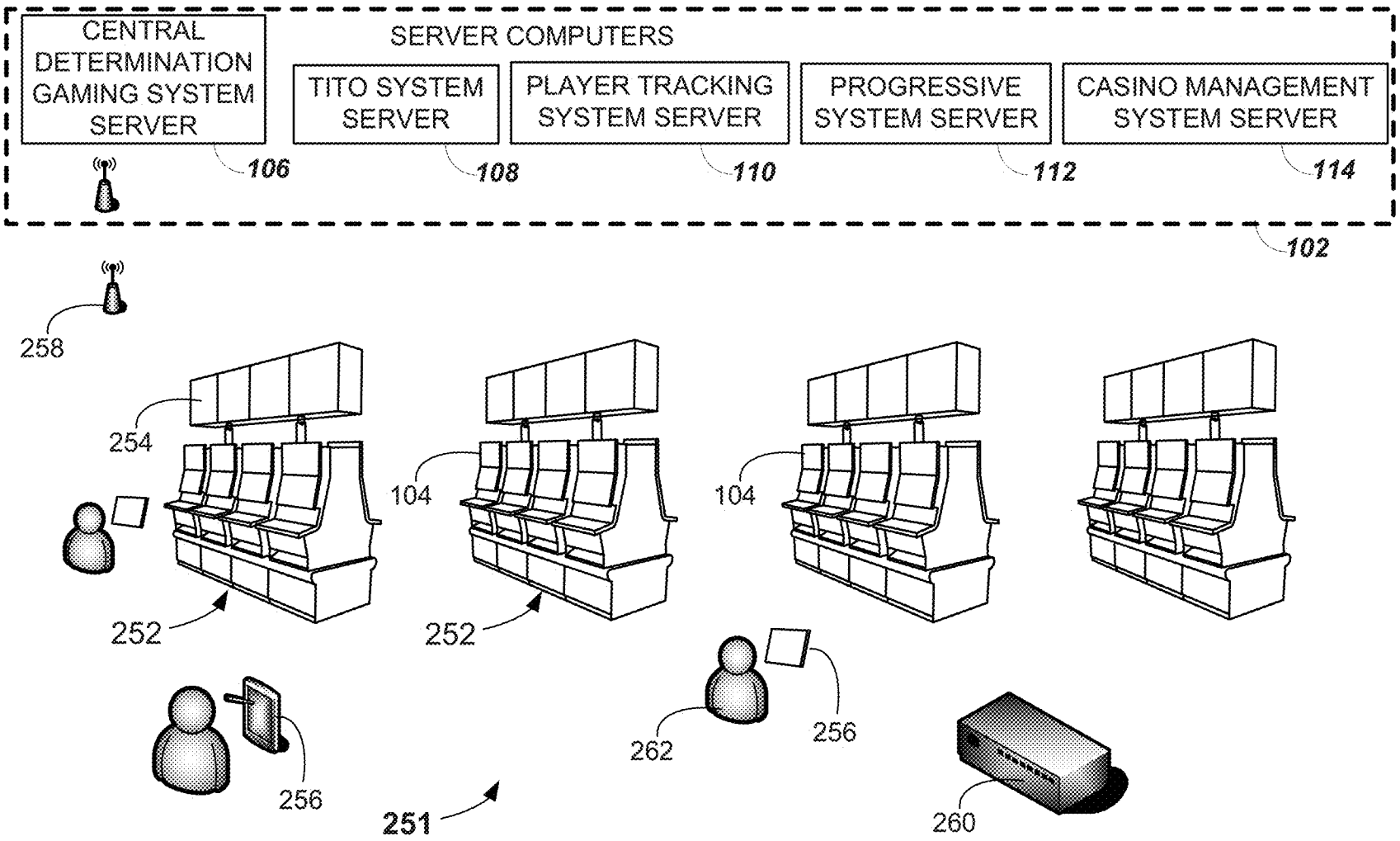
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other hand-held devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor (s) to verify the identity of an authorized patron. Some mobile gaming devices 256 may be configured to function only within a predetermined or configurable area, such as a casino gaming area.

Figure 2C:
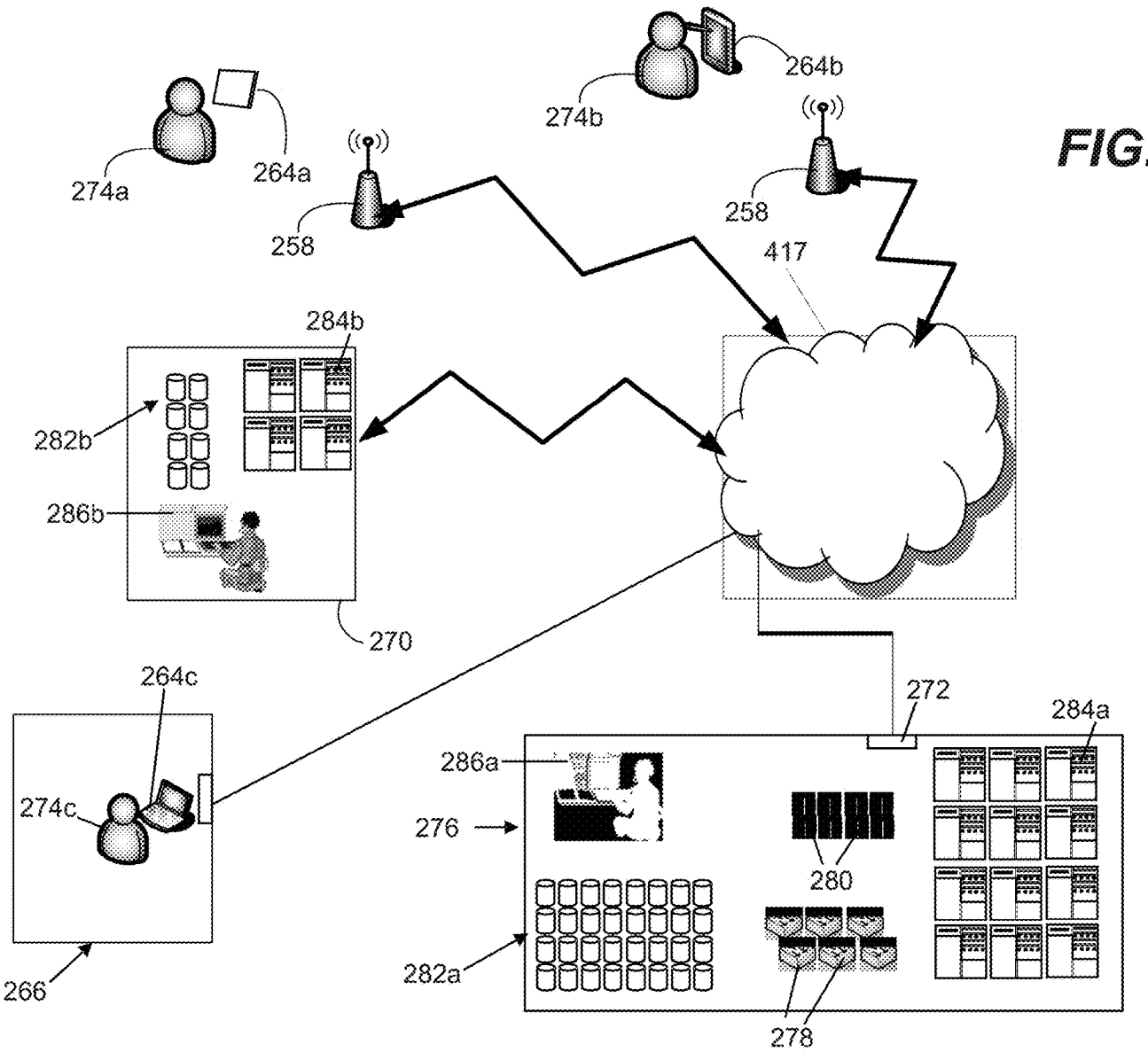
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server (s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3A:
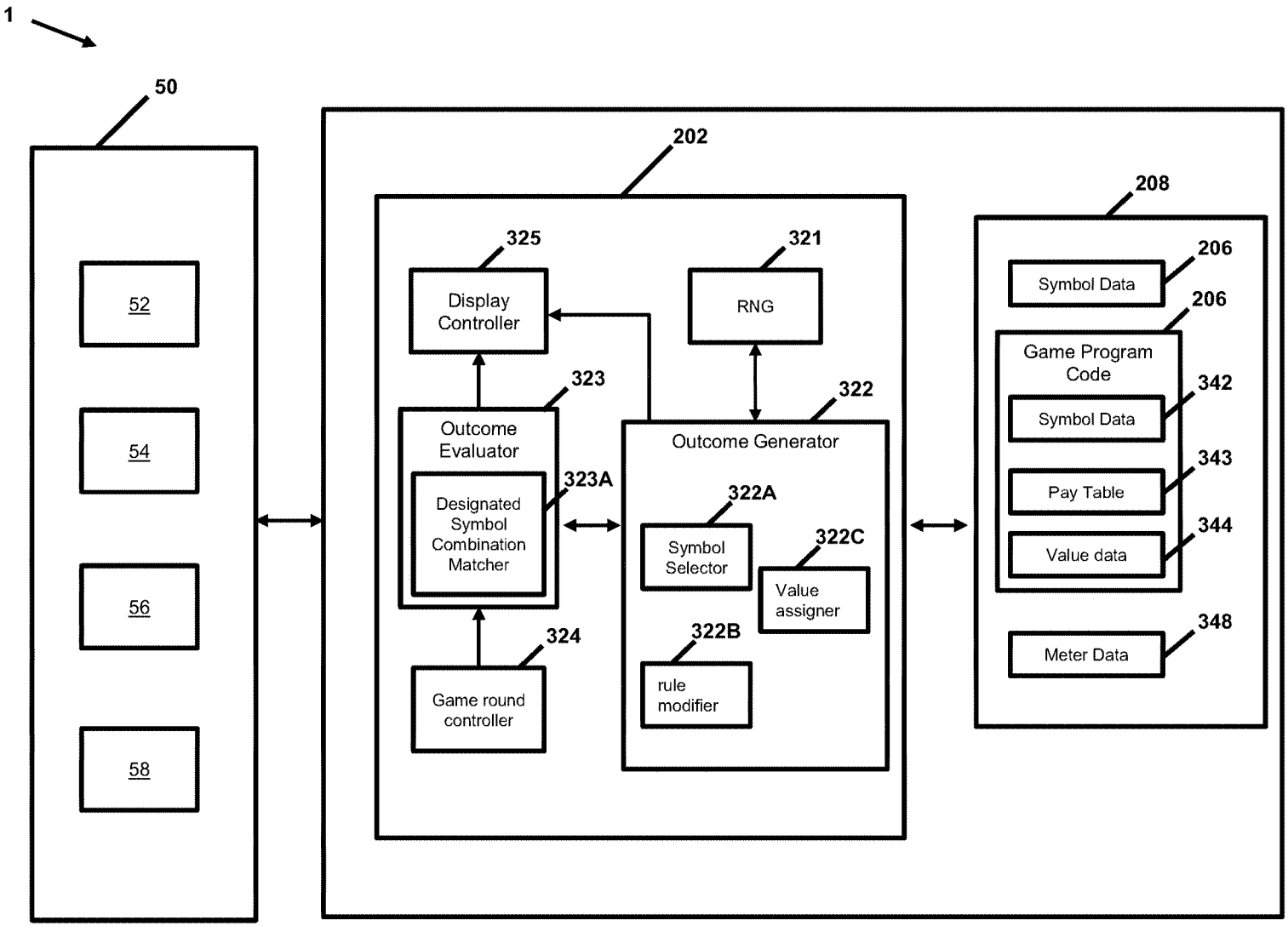
FIG. 3A is a further block diagram showing various functional elements of an embodiment of the game controller of FIG. 2A.

In FIG. 3A, the processor 204 of game controller 202 of gaming device 200 is shown implementing a number of modules based on game program code 206 stored in memory 208. Persons skilled in the art will appreciate that several of the modules could be implemented in some other way, for example, by a dedicated circuit. The game controller 202 is an example of what may be referred to herein as a "control system." In some implementations, the control system also may include the memory 208. Other examples of control systems are disclosed herein.

According to this example, these modules include an outcome generator 322 which operates in response to the player's operation of player input buttons 236 to place a wager and initiate a play of the game and generates a game outcome which will then be evaluated by outcome evaluator 323. In some examples, the first part of forming the game outcome may be for a symbol selector 322A to select symbols from a set of symbols specified by symbol data 342 using a random number generator 321. The selected symbols may be advised to the display controller 325, which causes them to be displayed as a symbol display on primary game display 240 at a set of display positions.

In certain embodiments, the symbol data 342 includes one or more virtual reels that correspond to one or more reels displayed by the primary game display 240. The virtual reels may include an arrangement of symbols selected from symbol data 342 in, for example, a predetermined or random manner. The symbol selector 322A may select a stop position for the one or more virtual reels based on one or more outcomes of the random number generator 321. The stop position of the one or more reels then determines the symbols that are selected on the primary game display 240. In some alternative implementations, the functionality of one or more of the modules shown in FIG. 3A may be implemented in another device, e.g., in a server. For example, the functionality of the RNG 321, the outcome generator 322, the outcome evaluator 323 and/or the game round controller 324 may be implemented in a device that is configured for communication with the gaming device 200.

In the embodiment described below, the display positions of the symbol display are arranged in a rectangular matrix comprising a plurality of columns and a plurality of rows. However, other arrangements known in the gaming industry could be employed in embodiments of the disclosure. For example, in some arrangements, there are more symbols in some columns than in others, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighboring reel.

Figure 3B:
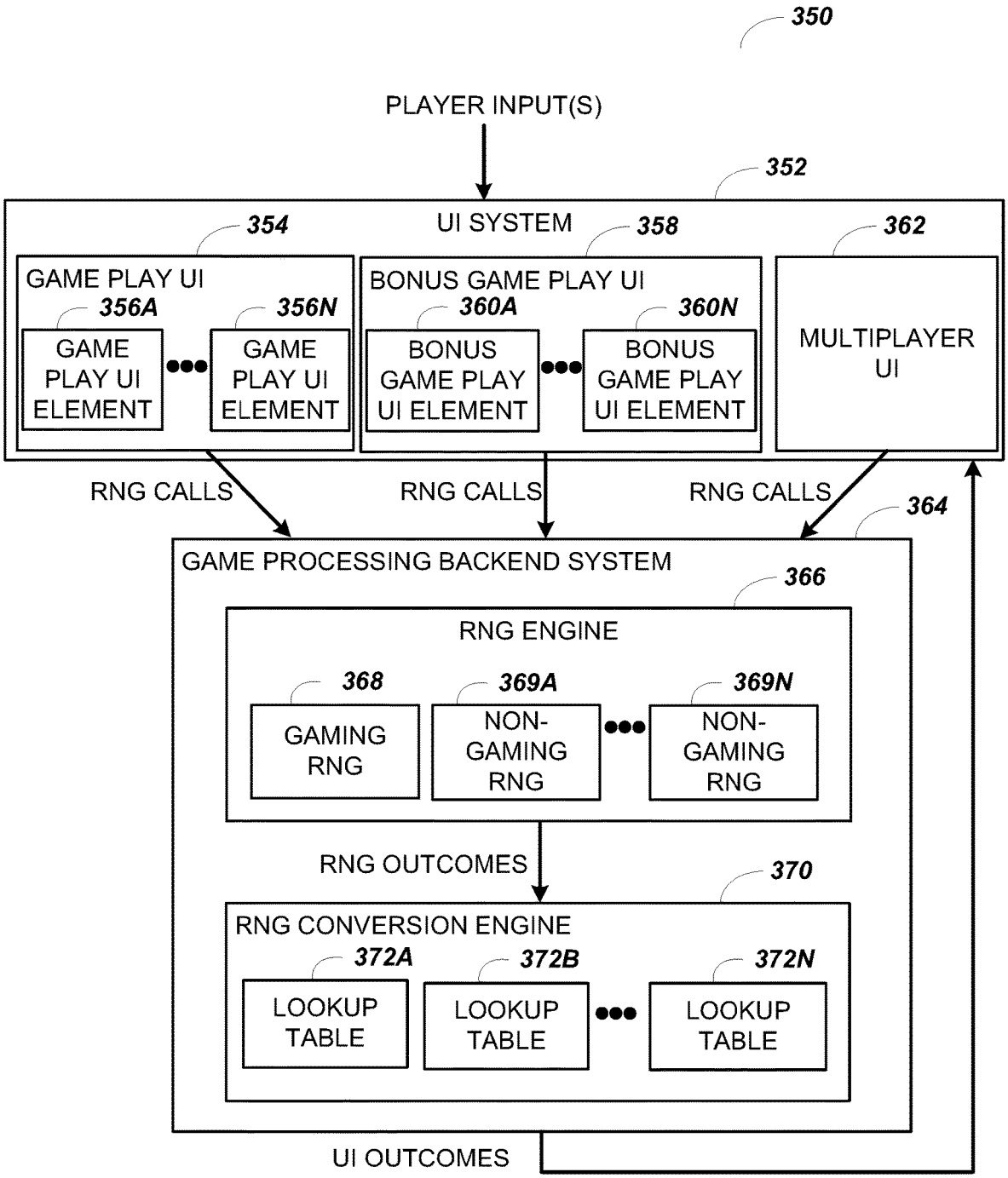
FIG. 3B illustrates, in block diagram form, an embodiment of a game processing architecture algorithm that implements a game processing pipeline for the play of a game in accordance with various embodiments described herein.

FIG. 3B illustrates, in block diagram form, an embodiment of a game processing architecture 350 that implements a game processing pipeline for the play of a game in accordance with various embodiments described herein. As shown in FIG. 3B, the gaming processing pipeline starts with having a UI system 352 receive one or more player inputs for the game instance. Based on the player input(s), the UI system 352 generates and sends one or more RNG calls to a game processing backend system 364. Game processing backend system 364 then processes the RNG calls with RNG engine 366 to generate one or more RNG outcomes. The RNG outcomes are then sent to the RNG conversion engine 370 to generate one or more game outcomes for the UI system 352 to display to a player. The game processing architecture 350 can implement the game processing pipeline using a gaming device, such as gaming devices 104A-104X and 200 shown in FIGS. 1 and 2, respectively. Alternatively, portions of the gaming processing architecture 350 can implement the game processing pipeline using a gaming device and one or more remote gaming devices, such as central determination gaming system server 106 shown in FIG. 1.

The UI system 352 includes one or more UIs that a player can interact with. The UI system 352 could include one or more game play UIs 354, one or more bonus game play UIs 358, and one or more multiplayer UIs 362, where each UI type includes one or more mechanical UIs and/or graphical UIs (GUIs). In other words, game play UI 354, bonus game play UI 358, and the multiplayer UI 362 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3B as an example, the different UI elements are shown as game play UI elements 356A-356N and bonus game play UI elements 360A-360N.

The game play UI 354 represents a UI that a player typically interfaces with for a base game. During a game instance of a base game, the game play UI elements 356A-356N (e.g., GUI elements depicting one or more virtual reels) are shown and/or made available to a user. In a subsequent game instance, the UI system 352 could transition out of the base game to one or more bonus games. The bonus game play UI 358 represents a UI that utilizes bonus game play UI elements 360A-360N for a player to interact with and/or view during a bonus game. In one or more embodiments, at least some of the game play UI element 356A-356N are similar to the bonus game play UI elements 360A-360N. In other embodiments, the game play UI element 356A-356N can differ from the bonus game play UI elements 360A-360N.

FIG. 3B also illustrates that UI system 352 could include a multiplayer UI 362 purposed for game play that differs or is separate from the typical base game. For example, multiplayer UI 362 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 366 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3B does not explicitly depict that multiplayer UI 362 includes UI elements, multiplayer UI 362 could also include one or more multiplayer UI elements.

Based on the player inputs, the UI system 352 could generate RNG calls to a game processing backend system 364. As an example, the UI system 352 could use one or more application programming interfaces (APIs) to generate the RNG calls. To process the RNG calls, the RNG engine 366 could utilize gaming RNG 368 and/or non-gaming RNGs 369A-369N. Gaming RNG 368 corresponds to RNG 212 shown in FIG. 2. As previously discussed with reference to FIG. 2, gaming RNG 368 often performs specialized and non-generic operations that comply with regulatory and/or game requirements. For example, because of regulation requirements, gaming RNG 368 could be a cryptographic random or pseudorandom number generator (PRNG) (e.g., Fortuna PRNG) that securely produces random numbers for one or more game features. To generate random numbers, gaming RNG 368 could collect random data from various sources of entropy, such as from an operating system (OS) and/or a hardware based RNG (not showing in FIG. 3B). Alternatively, non-gaming RNGs 369A-369N may not be cryptographically secure and/or be computationally less expensive. Non-gaming RNGS 369A-369N can, thus, be used to generate outcomes for non-gaming purposes. As an example, non-gaming RNGs 369A-369N can generate random numbers for such as generating random messages that appear on the gaming device.

The RNG conversion engine 370 processes each RNG outcome from RNG engine 366 and converts the RNG outcome to a UI outcome that is feedback to the UI system 352. With reference to FIG. 2, RNG conversion engine 370 corresponds to RNG conversion engine 212 used for game play. As previously described, RNG conversion engine 370 translates the RNG outcome from the RNG 212 to a game outcome presented to a player. RNG conversion engine 370 utilizes one or more lookup tables 372A-372N to regulate a prize payout amount for each RNG outcome and how often the gaming device pays out the derived prize payout amounts. In one example, the RNG conversion engine 370 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game. In various embodiments, RNG 212 could be a physical device such as a co-processor with memory that executes instructions to generate random numbers. In certain embodiments, RNG 212 could be implemented in processor 204.

After generating the UI outcome, the game processing backend system 364 sends the UI outcome to the UI system 352. Examples of UI outcomes are symbols to display on a video reel or reel stops for a mechanical reel. In one example, if the UI outcome is for a base game, the UI system 352 updates one or more game play UI elements 356A-356N, such as symbols, for the game play UI 354. In another example, if the UI outcome is for a bonus game, the UI system could update one or more bonus game play UI elements 360A-360N (e.g., symbols) for the bonus game play UI 358. In response to updating the appropriate UI, the player may subsequently provide additional player inputs to initiate a subsequent game instance that progresses through the game processing pipeline.

Figure 4:
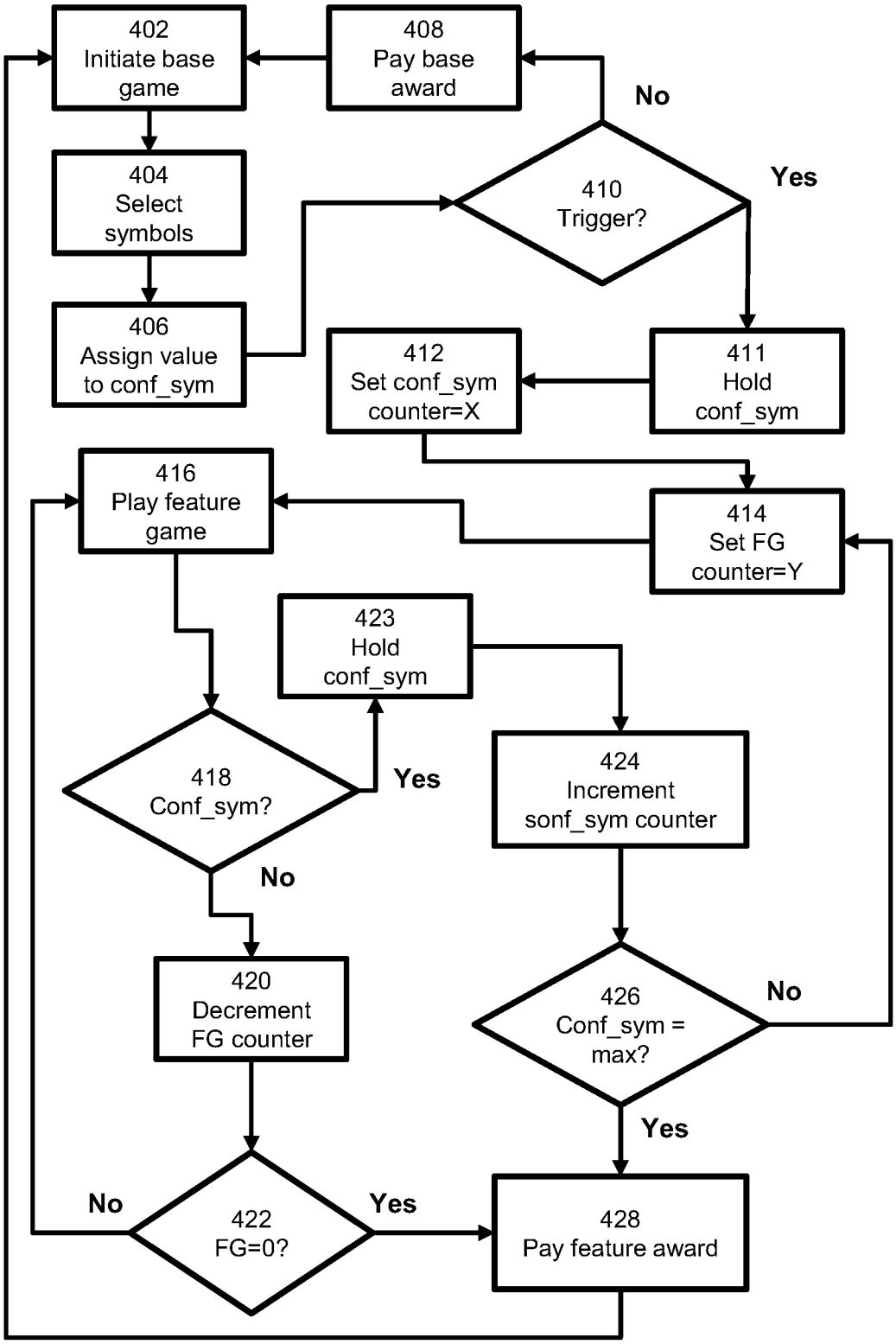
FIG. 4 is a flow diagram for an example embodiment of a process for operating the EGM of FIG. 2A in accordance with various aspects of the present disclosure.

FIG. 4 shows a flow diagram of one embodiment in which a feature game may be triggered from play of the base game at step 402. In this embodiment, the base game comprises using symbol selector 322A of FIG. 3A to select a plurality of symbols from a set of symbols to display at the respective display positions arranged on primary game display 240 at step 404. The set of symbols, which are stored as symbol data 342 in memory 208 according to this example, comprises a plurality of configurable symbols and non-configurable symbols.

Figures 6A, 6B, 6C:
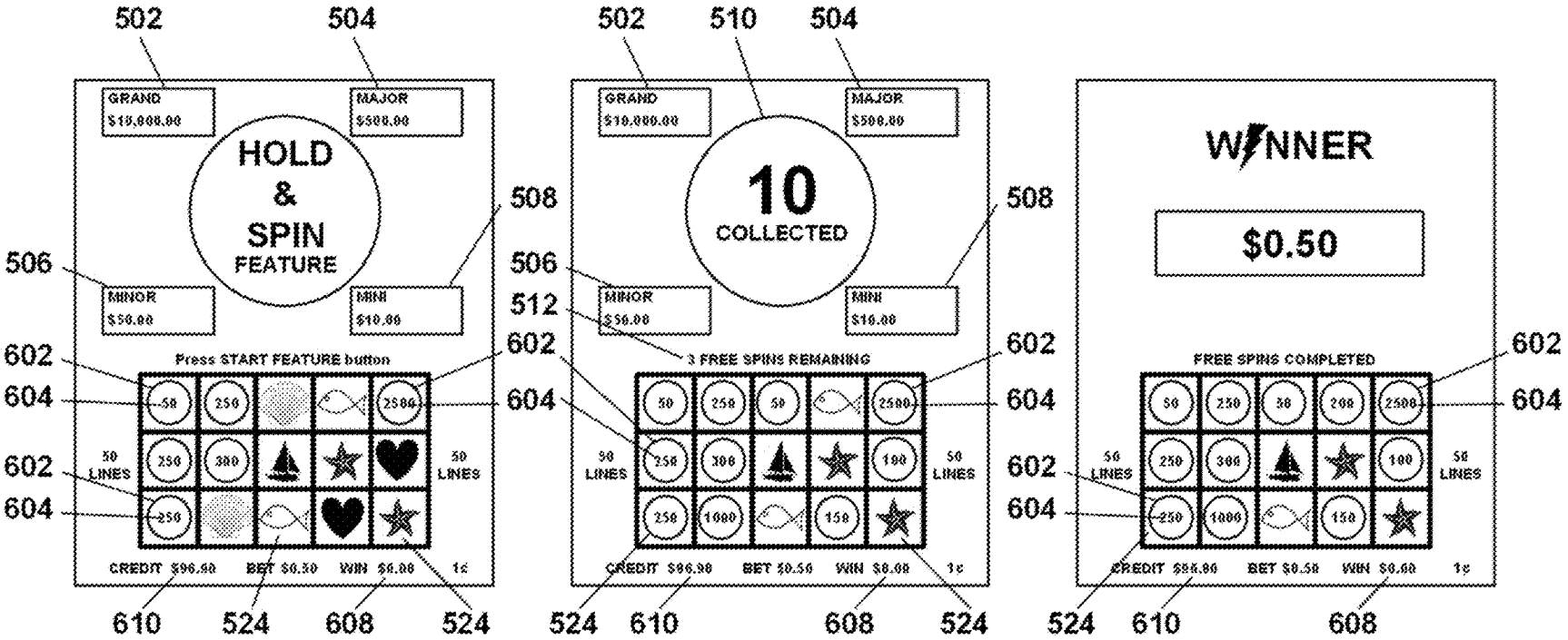
FIGS. 6A to 6C are screenshots of an embodiment of the feature game of FIG. 4.
Figure 7B:
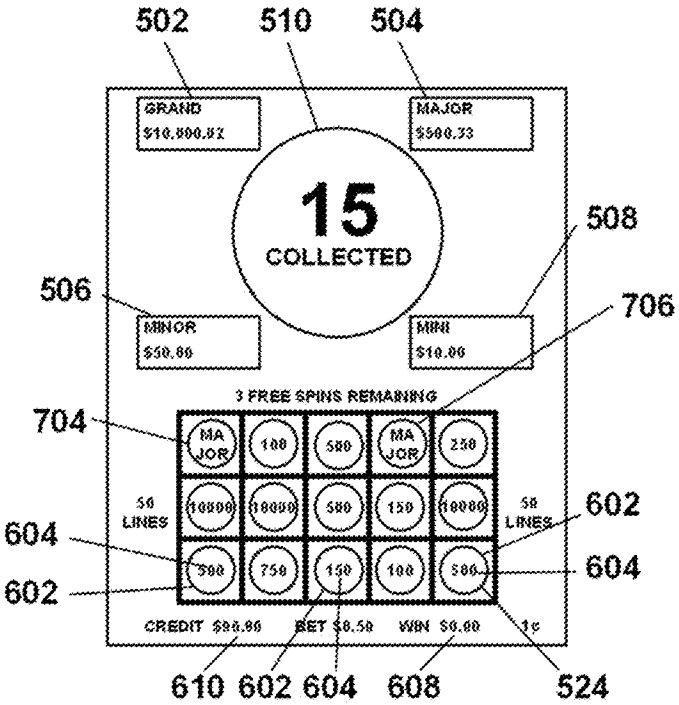
FIGS. 7A and 7B are screenshots of an embodiment of the feature game of FIG. 4, showing one of the progressive jackpots being awarded.
Figure 7A:
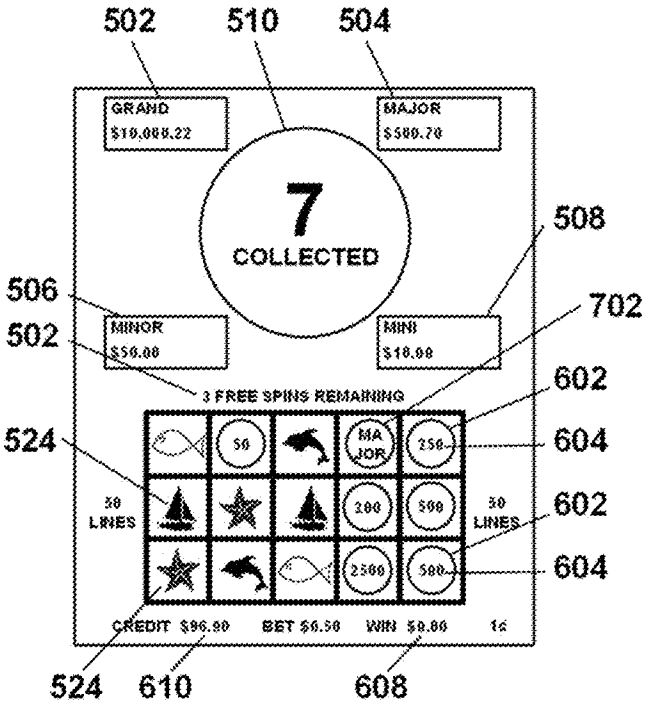

In an embodiment, the configurable symbols each comprise at least a common component and at least a variable component. The variable component is indicative of a value of a prize that is associated with each of the configurable symbols. An example of a configurable symbol is shown in FIGS. 6A-6C in the form of a pearl symbol. The common component is the pearl itself 602, while the variable component is the indicia 604 overlaying pearl 602. In this case, indicia are numerals directly indicative of the value of the prize. In other embodiments, as shown in FIGS. 7A-7B, the indicia indirectly indicates the value of the prize, such as "major" indicia 702, "minor" indicia 704 or "mini" indicia 706. It will be appreciated that the indicia can also be in other forms which may also be indicative of a prize. For example, a car icon may indicate that the player has the opportunity to win, or has won, a car. In some embodiments, the indicia may indicate only a portion of a prize. Continuing with the car example, the car icon may be split into four portions, each portion being assigned to a different configurable symbol. In such embodiments, all four portions of the car icon are required to be selected for display in order for the car prize to be won.

In some embodiments, at least one value of the respective prizes is generated by randomly selecting one of a plurality of defined multipliers that is applied to an amount wagered on the base game from which the feature is game triggered. According to some such embodiments, this may be accomplished at step 406 using value assigner 322C, which selects the predefined multipliers from value data 344 using a value obtained from the random number generator (RNG) 321, applies the multiplier to the initial wager to obtain a prize value and assigns the prize value to each of the configurable symbols selected by symbol selector 322A. The plurality of defined multipliers in some such embodiments may be selected at random according to a weighted probability based at least in part on the amount wagered on the base game. That is, the value assigner 322C may obtain a value from RNG 321 and may use this value to determine from the weighted table which value to assign to a configurable symbol. In an embodiment, the assignment of values to the configurable symbols is performed by the value assigner 322C after the symbols have been selected and the game controller knows they will be displayed but before they are displayed on the display. In another embodiment, the assignment occurs after the symbols have been displayed on display 240. In another embodiment, values are assigned to all configurable symbols irrespective of whether they will be displayed.

In this or other embodiments, at least one value of the respective prizes may comprise a defined value and/or a jackpot. As used herein, the term "jackpot," as opposed to "prize," refers to a progressive prize which accumulates over multiple plays of the base game and/or the feature game. As will be appreciated, the jackpot may be funded from a variety of sources including from only the gaming machine 200 itself, or from a plurality of gaming devices 200—a so-called "link". Furthermore, the jackpot may be triggered by any means known in the art, such as by using a mystery trigger or by using the Hyperlink™ system developed by the applicant.

In another embodiment, the variable prizes may be randomly selected (e.g., under the control of value assigner 322C) from a set of available prizes. Specific prizes may be weighted to control the probability of certain prizes occurring. In some embodiments, there may be a plurality of sets of prizes and the value assigner 322C may be configured to choose the set of prizes from which values will be randomly selected based on a player's wager in the base game.

Returning to FIG. 4, at step 410, play of the base game is monitored (e.g., by the outcome evaluator 323) and it is determined whether a trigger event has occurred. In this embodiment, a trigger event occurs when six configurable symbols appear on primary game display 240. If a trigger event has not occurred, play of the base game continues and control reverts to step 402 once any awards are paid at step 408. However, if a trigger event does occur, the feature game (which may also be referred to herein as a "feature" or a "feature game round") initiates by first holding the configurable symbols in their respective display positions 524 at step 411. In this example, outcome generator 322 causes the feature game to be displayed on display 240 by retrieving symbol data 342 from memory 208 and passing the data to display controller 325, which controls display 240 to display the feature game. In other embodiments, more than or less than six symbols will be required to trigger the feature game. Alternatively, or additionally, the feature game may be modified in a way that is proportional to the number of configurable symbols that are displayed to trigger the feature game. For example, the average or total prize achievable in the feature game may be increased in proportion to the number of configurable symbols appearing.

Figure 5:
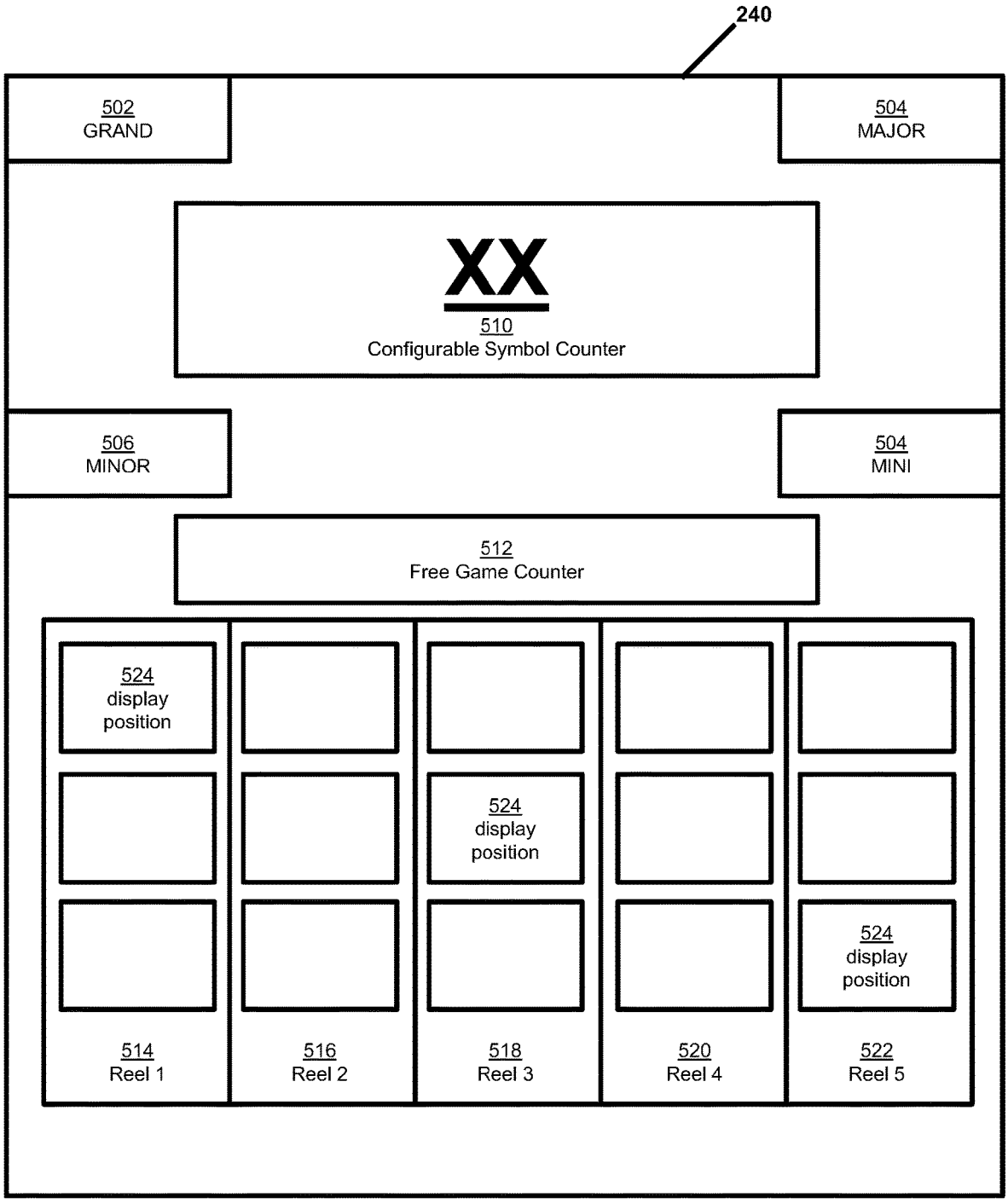
FIG. 5 is a representation of an example screen of the feature game of FIG. 4.

When the feature game starts, in various embodiments, the configurable symbol counter 510 of FIG. 5 is set to the number of configurable symbols that are held on reels 514-522 at step 412. In some embodiments, this is also the number of configurable symbols which originally triggered the feature game. That is, in some such embodiments, the configurable symbol counter 510 is initially set to 6, as six configurable symbols trigger the feature game. Alternatively, for example, if seven configurable symbols are selected for display, but only six are required for triggering the feature game, the configurable symbol counter 510 may be initially set to seven.

Once configurable symbol counter 510 is set, control moves to step 414 (FIG. 4) which sets free game counter 512 to the defined number of free games. In an embodiment, the preferred number of free games is three, so free game counter 512 is set to three. In other embodiments, the number of free games may be more than or less than three. For example, in some embodiments the number of free games may be 2, 4, 5, 6, 7 of 8. According to some implementations, the number of free games may be derived (e.g., by the game controller) from the number of configurable symbols that appear. For example, an additional free game may be offered for each configurable symbol that appears in addition to a predefined minimum number of configurable symbols (for example, six) that may be required to trigger the feature game.

Then, similar to the base game, symbols may be selected from symbol data (e.g., the symbol selector 322A may select symbols from symbol data 342) to be displayed in the other display positions 524 not already displaying a configurable symbol (e.g., via display controller 325) at step 416. Note that in certain embodiments, symbols in the feature game may be selected from a full set of available symbols (e.g., the full set of symbols defined by symbol data 342), including any configurable symbols. In other embodiments, the symbols may be selected from a reduced set of symbols taking into account any configurable symbols already held. For example, in one or more embodiments, only value symbols and blank symbols, i.e., a reel strip position not having any symbol, may be available for selection (e.g., by the symbol selector 322A). In an alternative embodiment, the symbols may be selected from an increased set of symbols. For example, symbols may be purchased or otherwise awarded for addition to the reel strip prior to initiating the feature game round. If one or more configurable symbols are selected, in this example value assigner 322C assigns randomly selected values to each configurable symbol.

According to this example, outcome evaluator 323 then monitors play of the feature game to determine whether a configurable symbol is selected and displayed at step 418. If an additional configurable symbol is not displayed, free game counter 512 is decremented by a defined amount, such as one, at step 420 in this example. In other embodiments, the free game counter 512 may be decremented by an amount, such as one, regardless of whether a configurable symbol is displayed.

If there are a number of free games remaining (for example, as determined by controller 202) at step 422, control returns to step 416 to continue the feature game round. On the other hand, once the number of free games is depleted, that is, when the free game counter 512 reaches zero, the feature game round ends and control returns to step 402 after any prizes are paid at step 428. In one embodiment, the accumulated value of all the individual prizes as indicated by the variable components of the collected configurable symbol is paid at step 428.

Returning to step 418, if it is determined (e.g., by outcome evaluator 323) that at least one configurable symbol is displayed on reels 514-522, then that symbol is held on the reel, at step 423, and the configurable symbol counter 510 is incremented at step 424. According to this example, it is then determined (e.g., by outcome evaluator 323) whether a defined number of configurable symbols has been displayed on reels 514-522 at step 426 and, if the defined number has been reached, a jackpot is paid at step 428.

The defined number of configurable symbols required to trigger a jackpot in certain embodiments is fifteen. That is, in certain embodiments in which a game is implemented using a 5×3 matrix, configurable symbols must be selected and displayed in all the matrix positions of reels 514-522. In other embodiments, the defined number may be more than or less than fifteen. For example, in a 3-4-3-4-3 matrix configuration as discussed above, the number of configurable symbols required to fill all matrix positions would be 17. In yet other embodiments, not all of the matrix positions need to necessarily be filled, and the number of configurable symbols required may be determined randomly.

In the above embodiments, the feature game ends when the Grand jackpot 502 is triggered at step 426. In other embodiments, the feature game round does not necessarily end at this point. In such embodiments, one or more of reels 514-522 are configured to expand and display additional configurable or non-configurable symbols when configurable symbol counter 510 reaches the defined number. For example, a game implemented using a 5×3 matrix may expand to a different configuration such as a 3-4-3-4-3 configuration. In such embodiments, a prize in addition to the Grand jackpot 502 is paid if configurable symbols are also selected for display in those additional positions.

Alternatively, if it is determined (e.g., by outcome evaluator 323) that the defined number of configurable symbols has not been reached at step 426, the feature game round may continue in some examples. In the embodiment of FIG. 4, each time a configurable symbol is displayed and the jackpot is not won, free game counter 512 is reset to the initial quantity by returning control to step 414, which, in this embodiment, is three as noted above. Therefore, the number of free games awarded by the outcome evaluator 323 is indefinite and is not determined by a defined limit.

In some embodiments, if no additional configurable symbols appear on reels 514-522 in any of the free games initially awarded, free games counter 512 is reset. Such embodiments ensure the player is guaranteed to win a prize over and above the prize payable for triggering the feature game.

In the above embodiments, the jackpot paid in response to configurable symbol counter 510 reaching the defined threshold is Grand prize 502. The Grand prize in this embodiment is a linked jackpot which receives contributions from a plurality of linked gaming machines and incremented based on the turnover of the linked machines. A linked jackpot may be a single site progressive (SSP), a multiple site progressive (MSP) or a wide area progressive (WAP). In some embodiments, a lower threshold of configurable symbols may be required for Major prize 504, Minor prize 506 or Mini prize 508 to be won. Alternatively or additionally, as shown in FIGS. 7A and 7B, Major, Minor and Mini prizes may be paid by assignment of those prizes to one of the configurable symbols, such as "major" indicia 702, "minor" indicia 704 or "mini" indicia 706.

Note that in some embodiments, one or all of the Grand prize 502, Major prize 504, Minor prize 506 and Mini prize 508 may be implemented as jackpots, as fixed bonus amounts that do not increment or as a mixture of both. In the embodiment of FIGS. 6A to 7B, as noted above, Grand prize 502 is implemented as a linked progressive jackpot, while Major prize 504 is implemented as a stand-alone progressive (SAP) jackpot which only takes contributions from the gaming machine itself, incrementing the jackpot as a function of turnover. Minor prize 506 and Mini prize 508 are implemented as fixed bonus amounts in proportion to the initial bet wagered. In some embodiments, Grand prize 502 may also be implemented as a SAP or the Major prize 504 may also be implemented as a linked jackpot.

This embodiment implements Grand prize 502 and Major prize 504 as jackpots and, while both may be awarded simultaneously, neither can be awarded more than once in the same feature game. However, in other embodiments, either jackpot may be won multiple times within the same feature game. In such embodiments, players are awarded a seed value (i.e., reset value) of the jackpot for subsequent triggers of that same jackpot.

As some embodiments of the feature game described above automatically adjust awards based on turnover and proportionality to the initial wager, such embodiments may be particularly suited to variable denomination games. Therefore, in some embodiments, controller 202 allows player selection of the minimum bet denomination. For example, before play of the game, controller 202 causes display controller 325 to output a message on display 240 requesting the player to select a minimum bet denomination. The player makes a selection through the game play mechanism 56 in response to which controller 202 adjusts the amount contributed to Grand prize 502 and Major prize 504 and the magnitude of Minor prize 506 and Mini prize 508. Controller 202 also adjusts the weightings of the values in value data 344 from which value assigner 322C may assign to the configurable symbols. In one embodiment, there are four denominations available for selection, 1c, 2c, 5c, and 10c. Those skilled in the art will appreciate that the denominations are not limited to four, but can include any suitable amount in any given currency. Note also that in this embodiment, while the selected denomination affects the magnitude of the Minor prize 506 and Mini prize 508, it does not affect the magnitude of the Grand prize 502 and Major prize 504.

EXAMPLES

More specific examples of embodiments of the present disclosure are now described with reference to FIGS. 6A to 7B. In general, as shown in these figures, the embodiment has a traditional 3×5 grid layout and is referred to in the examples below as the "hold and spin" feature.

Referring to FIG. 6A, the hold and spin feature is triggered when six (6) pearl symbols 602 are selected for display. When triggered, pearls 602 are held in their respective display positions, being all of column 1, column 2 at rows 1 and 2, and column 5 at row 1, and the controller 202 waits for a player instruction to initiate the game through player input buttons 236. In some embodiments, controller 202 will wait indefinitely while in other embodiments, controller 202 will wait for a predefined period of time before automatically initiating the game.

At this point, configurable symbol counter 510 is set to 6, and the player is guaranteed to win the accumulated value as indicated by the indicia 604 of the six pearls 602. That is, even before play of hold and spin starts, the player has won 3,600 credits in the embodiment of FIG. 6A.

Moving on to FIG. 6B, the player has spun an additional four (4) pearls 602. Accordingly, configurable symbol counter 510 is incremented from 6 to 10 and free games counter 512 is reset to the initial quantity, which is 3 feature games in this embodiment. As compared to FIG. 6A, the additional pearls 602 are selected for display at display positions C2R3, C3R1, C4R3 and C5R2, and are also held at those positions for the subsequent games. In various embodiments, instead of resetting the free games counter to the initial quantity, the free games counter is decremented by one for every spin that does not result in additional configurable symbols being displayed, and does not decrement by one when additional configurable symbols are displayed.

Over the remaining feature games, the player spins only one (1) additional pearl 602, displayed at C4R1, as shown in FIG. 6C. Accordingly, the free games end and the player wins the accumulated value of the values indicated on pearls 602. In this case, the total award is the 3,600 credits for the six (6) pearls 602 that originally triggered the hold and spin game, plus the additional five (5) pearls 602 selected during play of the hold and spin game—5,100 credits. In this embodiment, the accumulated award is totaled at the end of the hold and spin game and first transferred to the win meter 608 before being transferred to the credit meter 610 by the controller 202. Meter data 348 is adjusted accordingly before the next game can be initiated at step 402. In alternative embodiments, the accumulated award may bypass the win meter and be credited directly to the credit meter.

FIGS. 7A and 7B are examples showing the jackpots being won. In FIG. 7A, value assigner 322C has assigned "Major" indicia 702 to pearl 602, which has been selected for display at C4R1. This triggers Major prize 504 which, in one embodiment, is paid directly into credit meter 610 rather than first into win meter 608. That is, jackpot wins may be paid immediately when they are won rather than being accumulated at the end of the hold and spin game as per the other prizes described above. Thus in the FIG. 7A embodiment, Major jackpot 504 is paid when the associated pearl 602 is selected, while the remaining 4,000 credits will be accumulated and paid at the completion of the feature game, in addition to any new pearls 602 that are selected and displayed in the remaining free games. In alternative embodiments, the Major jackpot may be accumulated at the end of the feature game along with the other 4,000 credits, and the accumulated total may be paid first into win meter 608 or directly into credit meter 610.

FIG. 7B shows Grand jackpot 502 being triggered, as fifteen (15) pearls 602 have been selected for display in the matrix by the end of the feature game. Again, the Grand prize 502 is first accounted for and paid directly into credit meter 610, and the remaining prizes indicated by indicia 604 on pearls 602 are then accumulated and paid into win meter 608 before being transferred to credit meter 610. Therefore, in this FIG. 7B embodiment, the total winnings is made up of the initial Grand jackpot 502, plus 63,000 credits indicated by indicia 604 and Minor prize 506 and Mini prize 508 indicated by "Minor" indicia 704 and "Mini" indicia 706. Again, in alternative embodiments, the Grand jackpot may be accumulated at the end of the feature game along with the other 63,000 credits, Minor prize 506 and Mini prize 508, and the accumulated total may be paid first into win meter 608 or directly into credit meter 610. In various embodiments, since all available symbol display positions display the configurable symbols, e.g., pearls, at the end of the feature game, an additional prize such as a multiplier may be applied. The multiplier may be predetermined, such as a 2× multiplier, or randomly determined.

In another example, the configurable symbols may only be provided during part of the game, such as a feature game. In another example, after a feature game is triggered, a feature game may be initiated (e.g., by the game controller 202) using different reels to those used in the base game. Depending on the embodiment, the trigger may be the configurable symbol trigger described above or some other trigger, e.g., a symbol combination. In this example, in the feature game, individual reels are associated with each of the symbol display positions. That is, if there are fifteen symbol display positions, fifteen reels are used. Each of the reels may include a mixture of non-configurable symbols and configurable symbols. Before the free games, in some examples the configurable symbol counter is set to zero and none of the configurable symbols that trigger the free game are held over to the free game. In the first free game, the symbol selector determines stopping positions for all of the reels in some such examples. If any of the reels are stopped with a configurable symbol in place, that configurable symbol may be held in position by holding/locking the reel (i.e., not spinning the reels in a subsequent free game). That is, in subsequent free games according to this example, only the reels corresponding to symbol positions where a configurable symbol has not been displayed are re-spun. Each configurable symbol is assigned a value by value assigner by selecting a prize value from a set of prize values. The set of prize values from which values are selected depends on the player's wager in the base game. As in the example described above, a player is awarded the sum of the values of the configurable symbols at the end of the free games and may be awarded an additional prize such as a jackpot prize depending on what value the counter reaches during the free games.

In various embodiments, the prize value of each of the configurable symbols is predetermined on the basis of a selected wager amount and/or selected denomination value. In various embodiments, the prize value of each of the configurable symbols is determined (e.g., by the game controller 202) in response to a wager. In certain of these embodiments, the prize value may be determined on the basis of the selected wager amount and/or selected denomination.

In another example, the configurable symbol may have an alternative visual representation, for example, a door which opens once the configurable symbol is displayed in a display position to reveal the assigned prize value.

As indicated above, the method may be embodied in program code. The program code could be supplied in a number of ways, for example, on a non-transitory computer readable storage medium, such as a disc or a memory device, e.g. an EEPROM, (for example, that could replace part of memory 103). In some examples, the program code may be provided via data signals (for example, by transmitting the program code from a server). Further, different parts of the program code can be executed by different devices, for example, in a client-server relationship. Persons skilled in the art will appreciate that program code provides a series of instructions executable by a control system, e.g., via one or more processors.

Figure 8A:
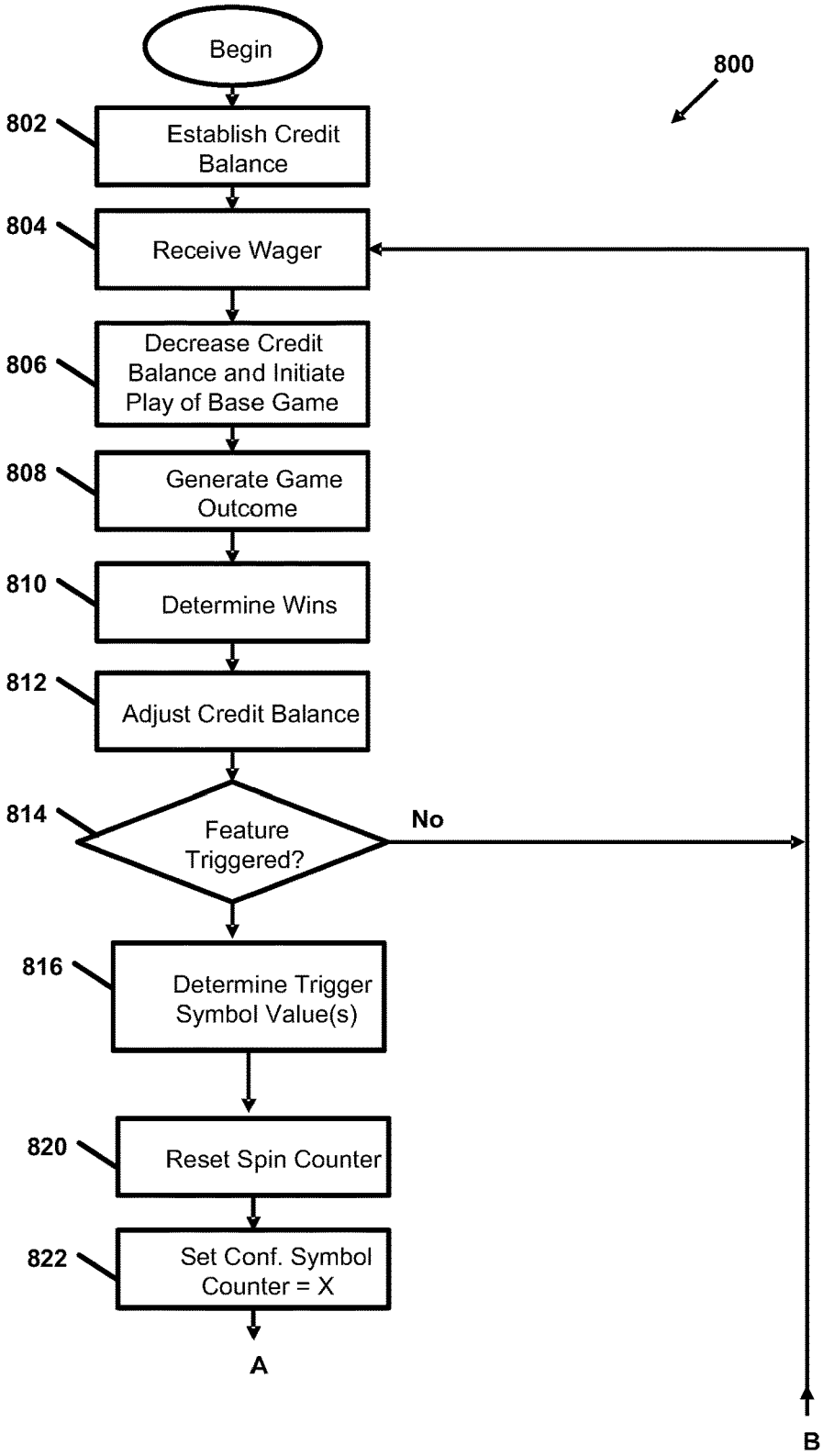
FIGS. 8A and 8B are flow diagrams for an example embodiment of a process for operating the EGM of FIG. 2A in accordance with various aspects of the present disclosure.
Figure 8B:
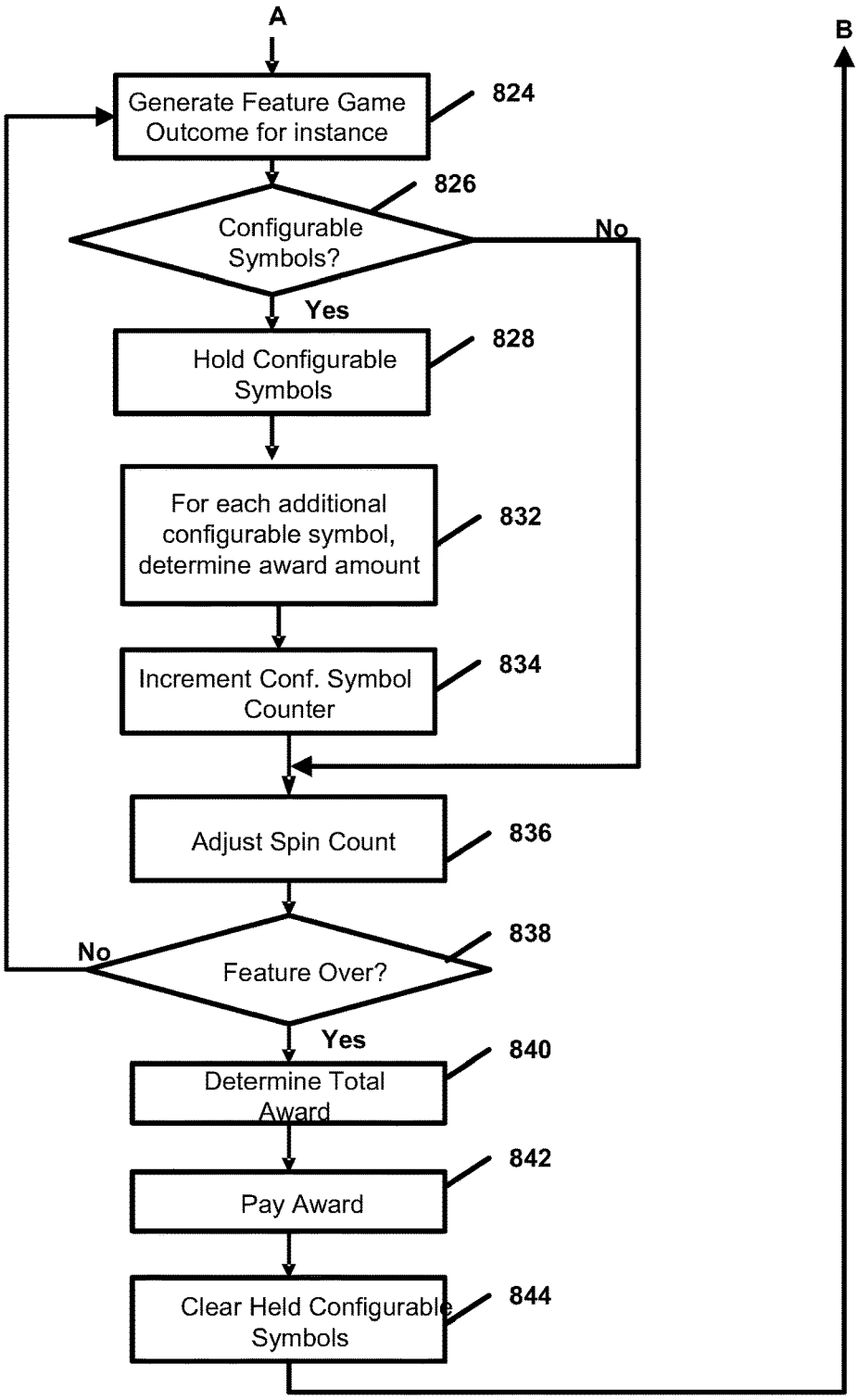

Examples of play of the base and feature game will now be described with additional reference to the flowchart 800 shown in FIGS. 8A and 8B. At 802, the gaming device 200 may establish an associated credit value on a credit meter. To this end, a player may insert a physical item having monetary value into a credit input mechanism or device, such as the ticket reader 224 or bill validator 234, of the gaming device 200. In response to the received physical item, the gaming device 200 may increase a credit value of the credit meter 1010 (see FIG. 10A) based on the monetary value of the physical item.

At 804, the gaming device 200 may receive a wager. A player may use the player input buttons 236 to specify a value of an amount to be wagered with the wager being funded by the credit value of the credit meter. The gaming device 200 may display a message such as "Press SPIN to play" in a message box, e.g., on the primary game display 240. When the player presses a SPIN button, e.g., in the player input buttons 236, the gaming device 200, at 806, may decrease the player's credit balance by the specified wager and initiate play of a spinning reel game by spinning reels one or more reels.

Next, at 808, the gaming device 200 may stop the reels based on one or more random values generated by RNG 212 to obtain a base game outcome comprising a matrix, or any other formation, of symbols. In other embodiments, the gaming device 200 may stop the reels based on information received from central determination gaming system server 106, or using a bingo game outcome.

The gaming device 200, at 810, may then determine whether the symbols displayed in the display matrix include one or more winning symbol combinations. For example, at 810, the gaming device 200 may determine if there are any winning combinations of symbols along one of the activated paylines. Winning symbol combinations along the activated paylines may result in the award of prize(s) by increasing the credit value of the credit meter based on the prize(s) for such winning combination(s).

At 812, the gaming device 200 may adjust the credit balance on the credit meter 535 in accordance with any winning symbol combinations that were identified in 806. The gaming device 200 may also control the display 240 to provide a message reflective of the game outcome. For example, when the game outcome includes one or more winning symbol combinations, the display 240 may display a message such as "Congratulations—You Won X Credits!" (where X is the number of credits won by the player). Conversely, when the game outcome does not include any winning symbol combinations, a message such as "Sorry—You Didn't Win—Spin Again" may be displayed to the player.

At 814, the gaming device 200 determines whether a feature triggering event occurred. The game triggering event may occur, for example, on the occurrence of a predetermined combination of symbols, or at random, or by some other process. As discussed herein, in the embodiment of FIGS. 10A-10K, a feature game is triggered by the appearance of 6 or more trigger symbols in a base game outcome. For example, the base game outcome shown in FIG. 10C triggers the feature game because it includes at least six (6) trigger symbols (star symbols). When a trigger event occurs, the gaming device 200 displays a message such as "Congratulations, You Triggered The HOLD AND SPIN FEATURE Game" on the primary game display 240. In various embodiments, the minimum number of trigger symbols needed to trigger the feature game may be predetermined, randomly determined, based on a wager amount, or based on a denomination, etc. In certain embodiments, the trigger symbols may be configurable symbols, or may be replaced with configurable symbols before or after the triggering of the feature game. The replacement may occur as a simple reveal animation where the trigger symbol reveals a value associated with the symbol, similar to the configurable symbols having a value associated with them.

If the feature game is not triggered, the process returns to 804 to allow the player to continue playing the base game. Alternatively, when a feature trigger occurs, the gaming device 200 may transition to a feature game as described below.

Prior to transitioning to the feature game, the gaming device 200 may, at 816, determine the value(s) of the trigger symbols that were displayed in the base game outcome that triggered the feature game. As discussed above, the gaming device 200 may determine the values to be assigned to the trigger symbols using a random determination, using weighted tables, or having preassigned values to each trigger symbol used in the primary game reels. Upon determining values for the triggering symbols, the gaming device 200 may cause the display 240 to replace the trigger symbols with their respective determined values. (See, e.g., FIGS. 10C and 10D, which illustrate the trigger symbols 1014 being updated to configurable symbols with their values being displayed). Although not illustrated, an animation may be shown when updating the display matrix 1004 to show values assigned to mystery symbols.

Before beginning the hold and spin feature game, the gaming device 200 also resets the spin counter to its starting value at 820. In the illustrated embodiment, the feature game provides 3 (three) rounds/spins, so the spin counter is reset to indicate that this is spin 1 of 3, or that there are 3 spins remaining.

In transitioning from the base game to the feature game, the gaming device 200 may cause the display 240 to provide a transition screen. When the player presses a Start Feature button, e.g., on the player input buttons 236, the game transitions the display 240 to present the hold and spin feature game. (See, e.g., FIG. 10E).

The gaming device 200 may display a message such as "Press SPIN to Play" on the display 240. When the player presses the SPIN button, the gaming device 200, at 824, controls the display matrix 830 to show reels 1008A 1008E as spinning (see, e.g., FIG. 10E) and stopping (based on one or more random values generated by RNG 212) to obtain a game outcome. As noted above, the symbol set in the feature game utilizes configurable and non-configurable symbols. Any configurable symbols that are carried over from the base game outcome are kept in their respective display positions for the remainder of the feature game. For example, the base game outcome of FIG. 10C had 6 trigger symbols, which were replaced with configurable symbols upon the trigger of the feature game. These 6 configurable symbols may be retained in their respective display positions for the remainder of the feature game. In various embodiments, the configurable symbols used in the feature game symbol set may be initially displayed without any values (reveal or mystery symbols), as the symbols are being shown spinning on the one or more reels corresponding to the one or more display positions in the feature game matrix. Upon landing, or in other word after the reels stop spinning and the symbols that form the outcome for that round or instance of the feature game are selected, the values associated with the configurable symbols may be revealed, or the symbols may be replaced with another symbol which displays the values.

The gaming device 200, at 826, may then determine whether the feature game outcome from the first spin includes any new configurable symbols. In the illustrated example, the first spin has resulted in the award of two additional configurable symbols 1050, namely, a 100 credit value symbol and a 50 credit value symbol. (See FIG. 10F). As discussed above, in certain embodiments, a reveal or mystery symbol may be first displayed and then be replaced with the values. If the feature game outcome does not include any new configurable symbols, control moves to 836.

Figure 9:
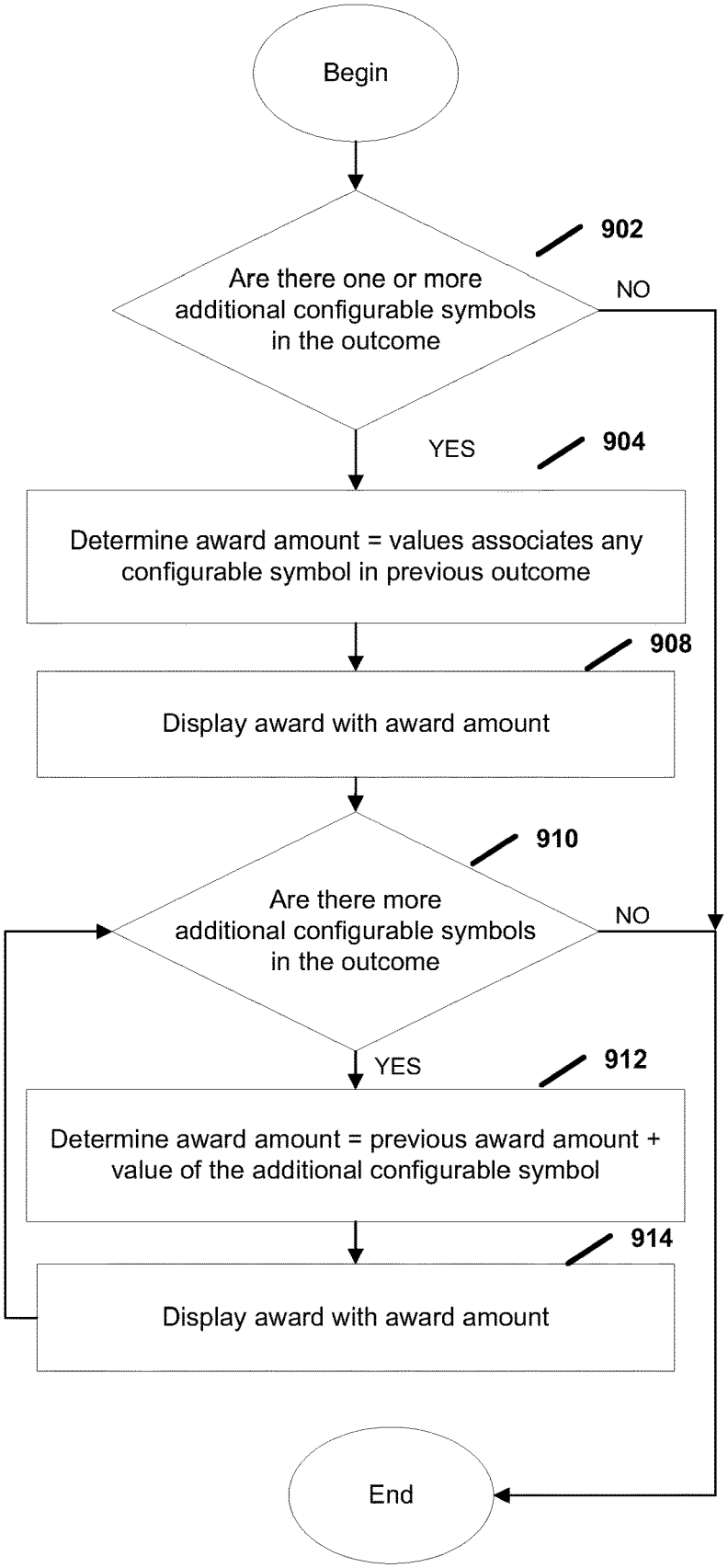
FIG. 9 is a flowchart depicting an exemplary process for determining the award amount of a spin or instance of a feature game outcome, in accordance with various embodiments of the present disclosure.

Next, at 828, any configurable symbols shown in the game outcome are held on the display matrix 1004. At 832, the gaming device 200 determines if the award amount for the spin or instance of the particular feature game outcome. This is based on the number of additional configurable symbols in that particular outcome or instance. FIG. 9 is a flowchart depicting an exemplary process for determining the award amount of a spin or instance of a feature game outcome, in accordance with various embodiments of the present disclosure.

At 834, the gaming device increments the configurable symbol counter 510 to reflect the number of configurable symbols that have been collected thus far by the player. Next, at 836, the gaming device 200 optionally adjusts the feature game spin counter 1030. In certain embodiments, the feature game may start with an initial quantity of spins or rounds. Prior to the start of a spin or instance, the gaming device 200 may decrease the number of available spins by a quantity, such as one. After the completion of a spin or instance, the remaining quantity may be adjusted based on the outcome of the spin or instance. For example, when the spin or instance results in one or more additional configurable symbols being selected, the feature game spin counter may be incremented by a quantity, such as one, or may be reset to the initial quantity. In certain embodiments, the feature game may start with an initial quantity of spins or rounds. Prior to the start of a spin or instance, the gaming device 200 may display that this is spin one of six, where six is the initial quantity of spins. After the completion of a spin or instance, the remaining quantity may be adjusted based on the outcome of the spin or instance. For example, when the spin or instance results in one or more additional configurable symbols being selected, the feature game spin counter may be incremented by a quantity, such as one, to display spin one of seven. In certain embodiments the feature game spin counter may not be incremented until all the initial quantity of spins are completed.

At 838, the gaming device 200 determines if the feature game is over. Specifically, the feature game ends in this example if no spins remain or if the matrix 1004 has been filled with configurable symbols.

If the feature game is not over, control returns to 824 where the gaming device 200 waits for the player to press the spin button to generate another feature game outcome. The feature game continues in the manner described until all of the spins have been completed or the display matrix is filled with configurable symbols.

Once the feature game is completed, control moves to 840 where the gaming device 200 determines the total award to be provided to the credit balance in connection with the feature game. If the matrix is not completely filled with configurable symbols, the award may be determined by summing awards from each round or instance of the feature game. An award meter may be maintained during the play of the feature game which tallies the award from each instance or spin of the feature game. An enhanced award may be provided for completely filling the display matrix 1004 with configurable symbols. In some embodiments, the enhanced award may be a fixed prize such as a 2× multiplier of the accumulated value, or one or more of the jackpot prizes. In some embodiments, the enhanced award may be determined via a second valuation game, such as second spinning wheel game.

Upon determining the award, control moves to 842 where the gaming device 200 pays out any awards to the player, e.g., by adding the awarded credits to the credit balance on the credit meter 535. Next, at 844, the gaming device 200 clears the held configurable symbols and control returns to 802 where the player may continue to play the base game.

Iterative Awards

FIG. 9 is a flowchart depicting an exemplary process for determining the award amount of a spin or instance of a feature game outcome, in accordance with various embodiments of the present disclosure. As previously discussed, various embodiments of the present disclosure provide for determining an award for each round or instances of the hold and spin feature game. This is based on awards provided, if any, in previous rounds or instances, and configurable symbols in the outcome of that instance. The following discussion describes how the flowchart of FIG. 9 is implemented by gaming device 200. In accordance with one such embodiment, a determination is made, at 902, whether the outcome of the spin or instance of the feature game includes any configurable symbols. This is determination may be made by only considering those symbols that were not held from any previous spin. For example, for determining whether the first spin of the feature game has any additional configurable symbols, any configurable symbols that were used to trigger the feature game may be excluded to make this determination. If there were one or more additional configurable symbols, control proceeds to 904. If there were no additional configurable symbols in the outcome of the spin or instance of the feature game, then the process for determining an award amount ends. Control may return to 834 and the play of the feature game may continue.

At 904, an award amount is determined for a first of the additional configurable symbols in the feature game outcome. In certain embodiments, the award amount is the sum of values associated with configurable symbols from the previous outcome, i.e., those that were held from the previous instance or outcome. In certain embodiments, the award amount is the sum of values associated with configurable symbols from the previous outcome, i.e., those that were held from the previous instance or outcome and one of the additional configurable symbols from the outcome. In certain embodiments, where one or more of the configurable symbols display a multiplier value, the multiplier may be applied to the award sum to determine the award value. In certain embodiments, where one or more of the configurable symbols displays a name of a jackpot, such as one of mini, minor, maxi, major or grand, the current value of that jackpot would be used for determining the award amount. In some embodiments, the value of the jackpot is reset to its starting value. In the example shown in FIGS. 10F-H, where there are 2 additional configurable symbols 1050 in the feature game outcome, two awards will be evaluated and provided, as described herein.

Figure 10A:
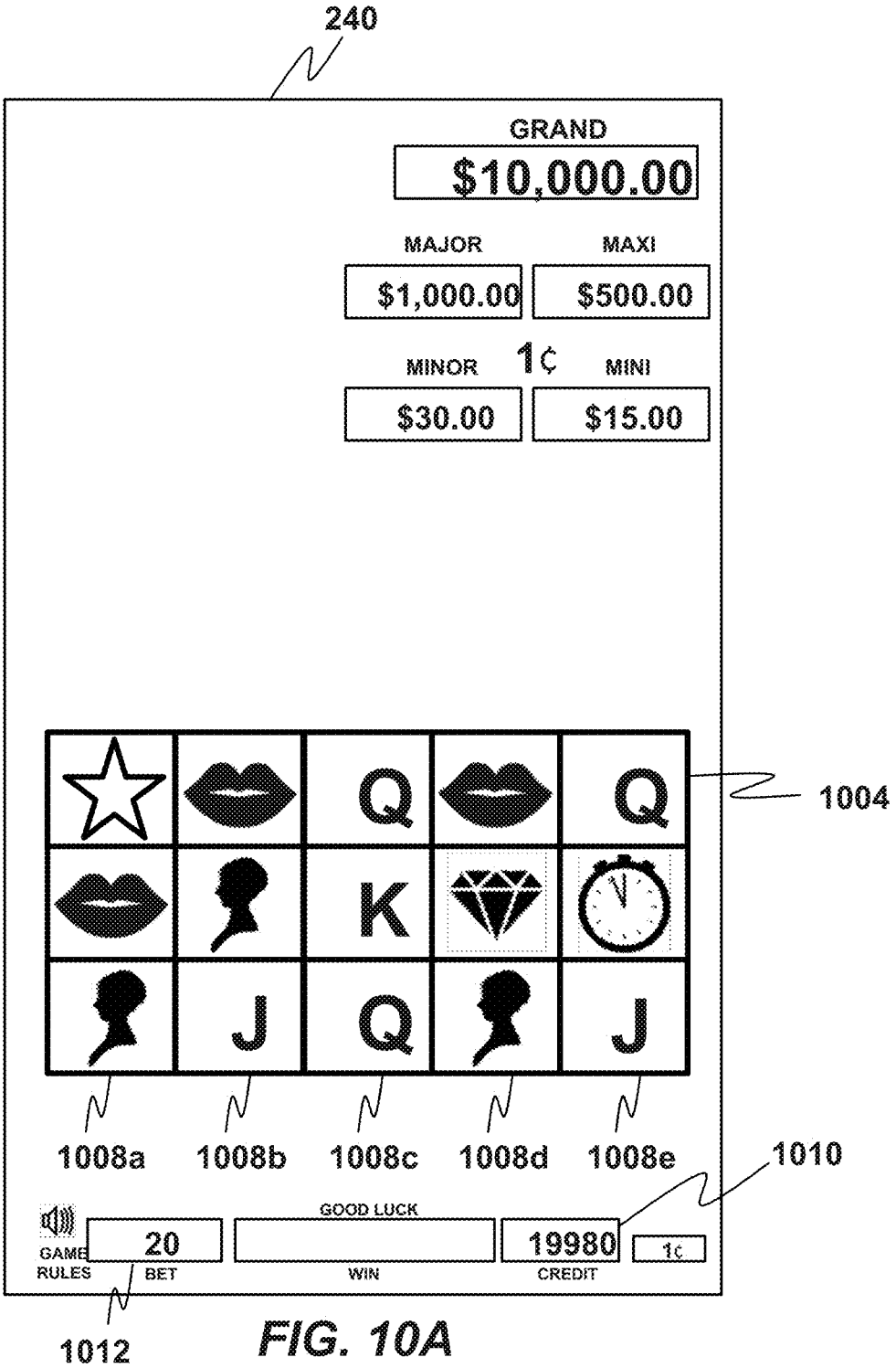
FIGS. 10A to 10K represent screen shots illustrating certain aspects of embodiments of the present disclosure.
Figure 10B:
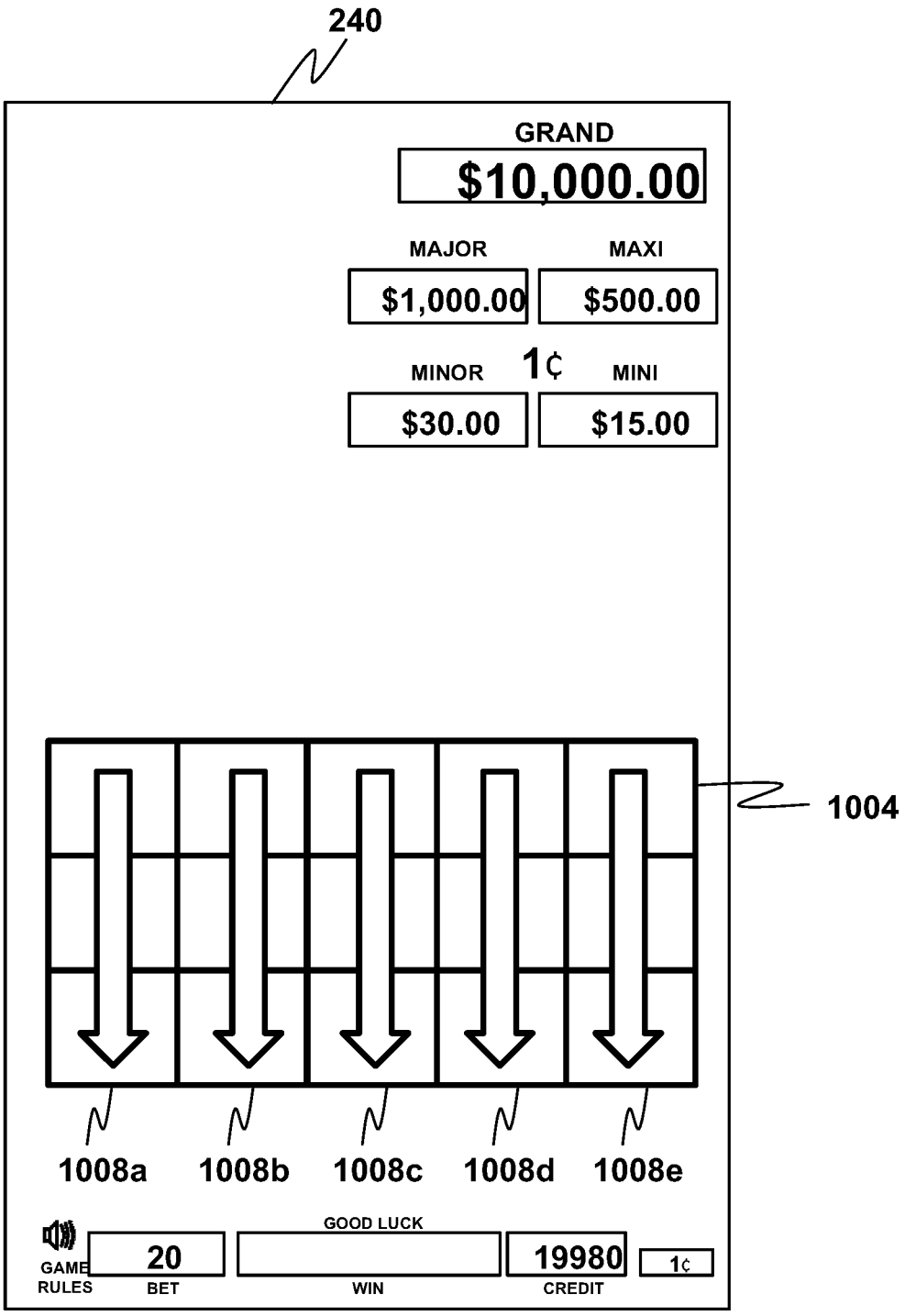
Figure 10C:
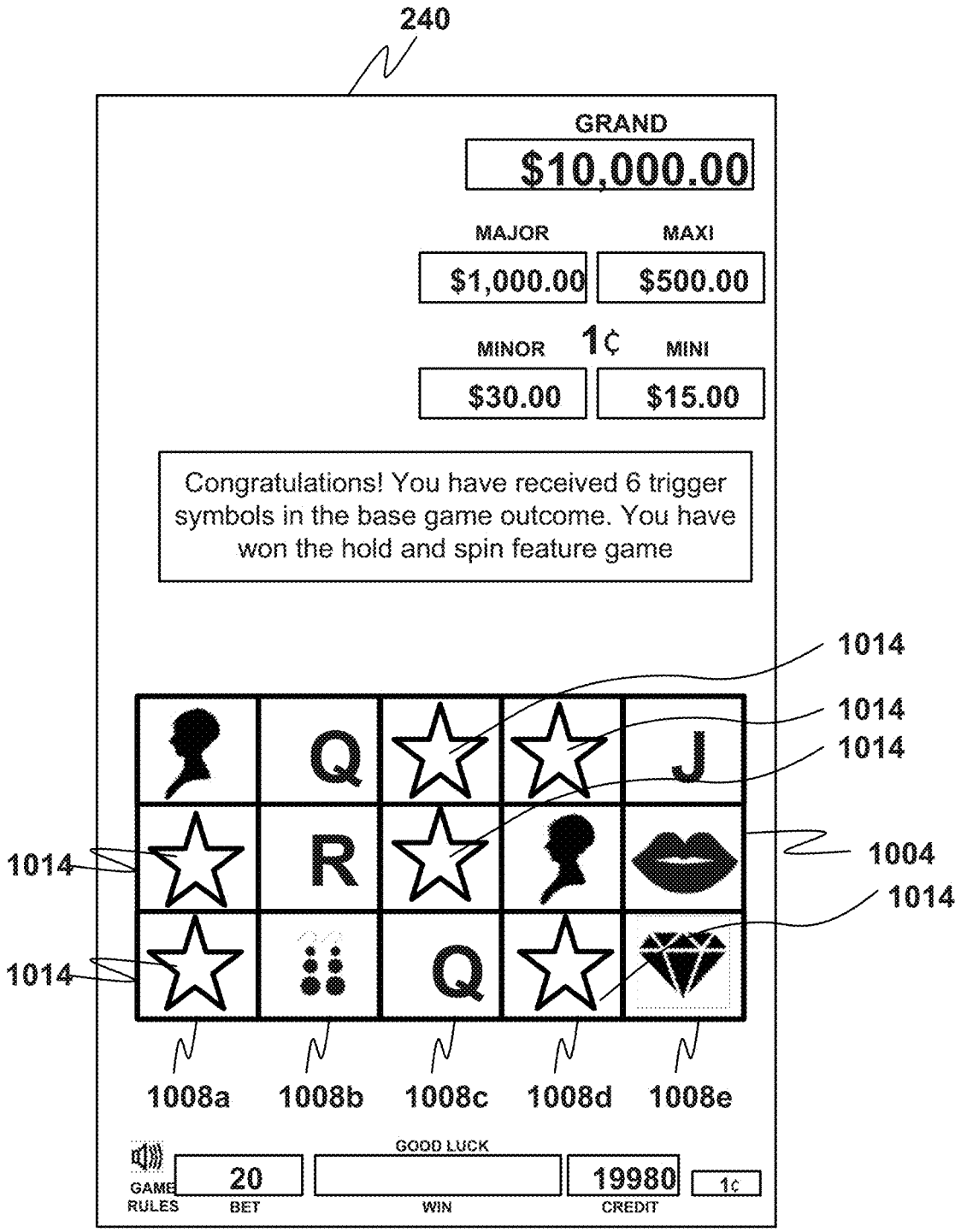
Figure 10D:
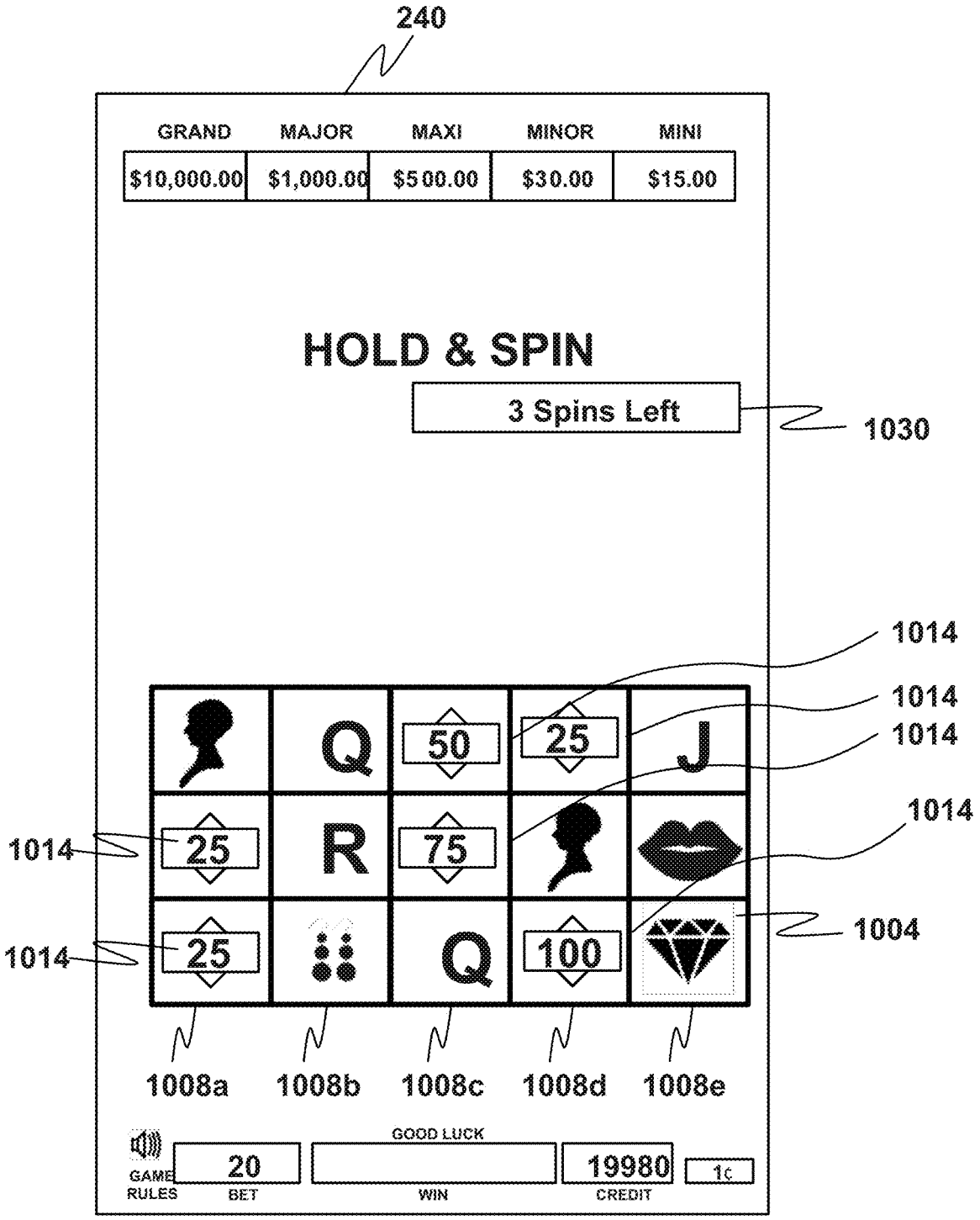
Figure 10E:
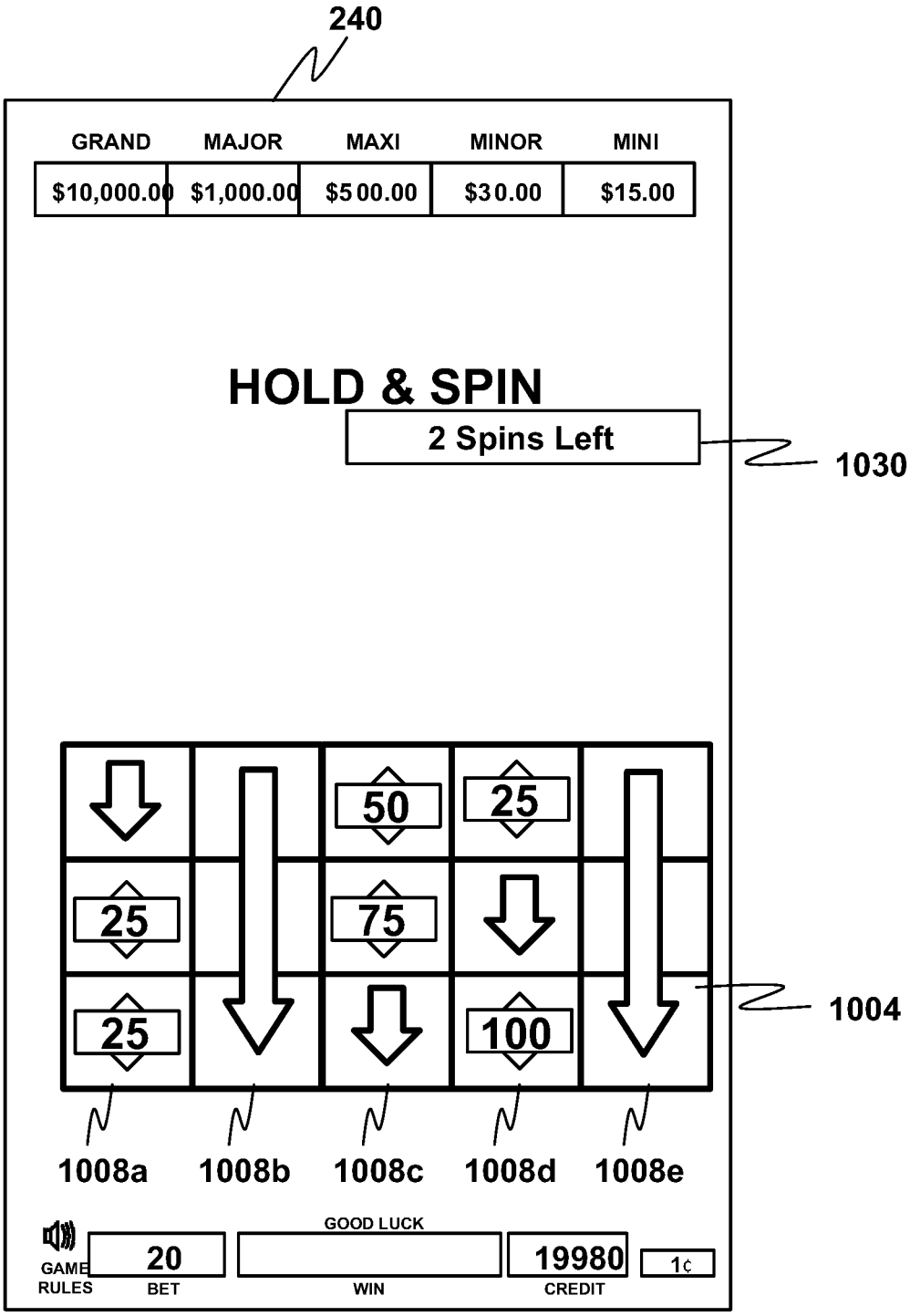
Figure 10F:
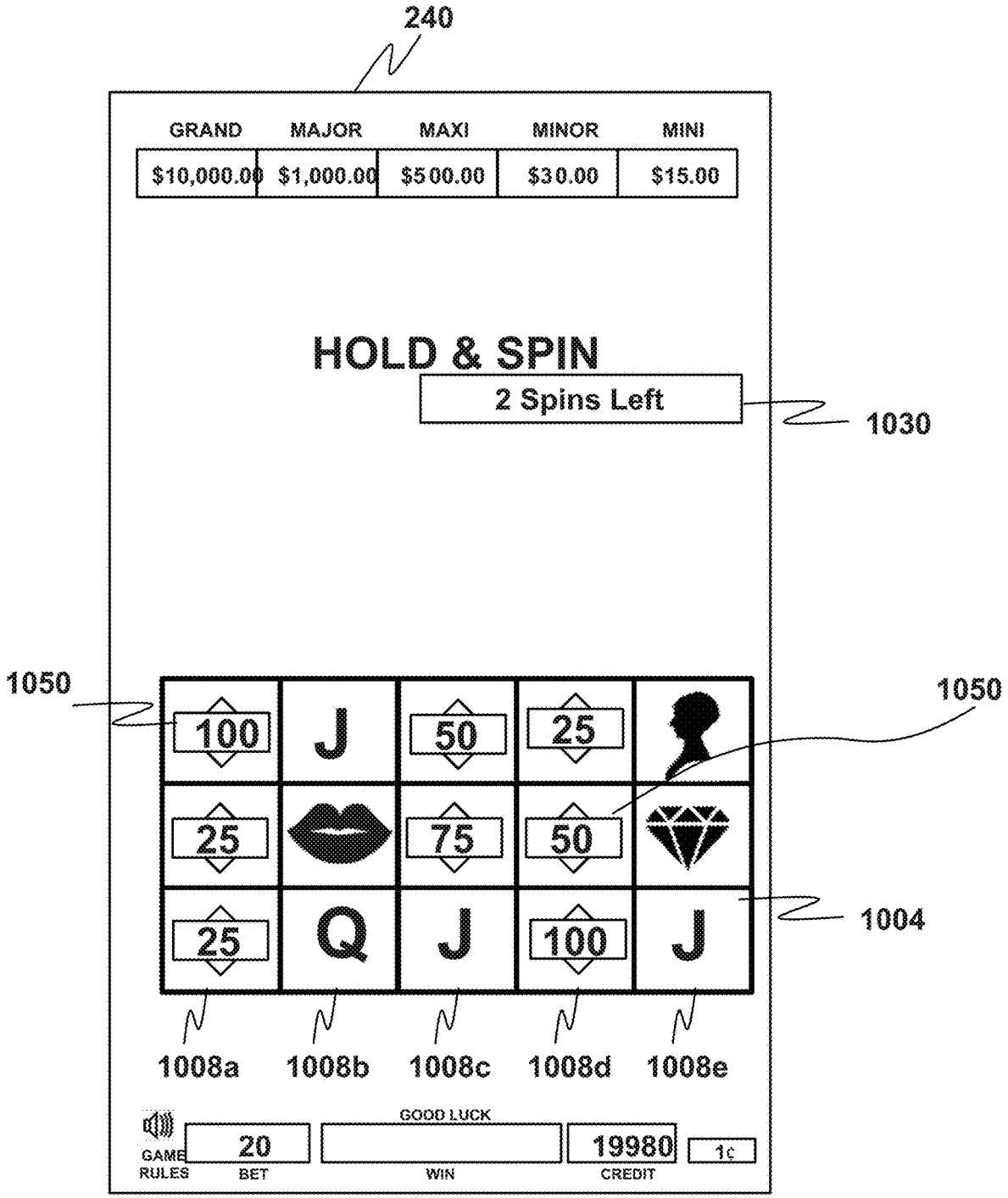
Figure 10G:
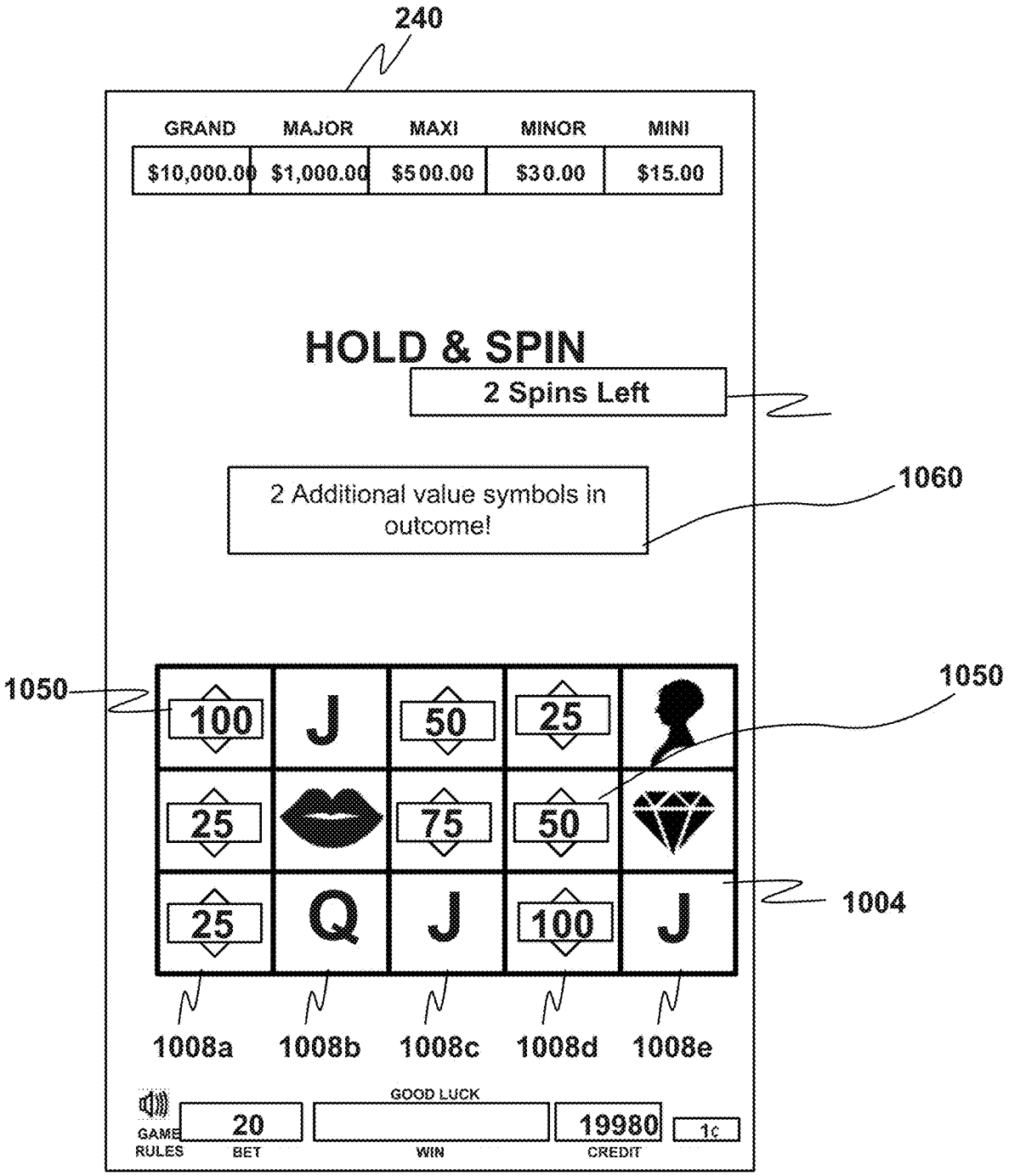
Figure 10H:
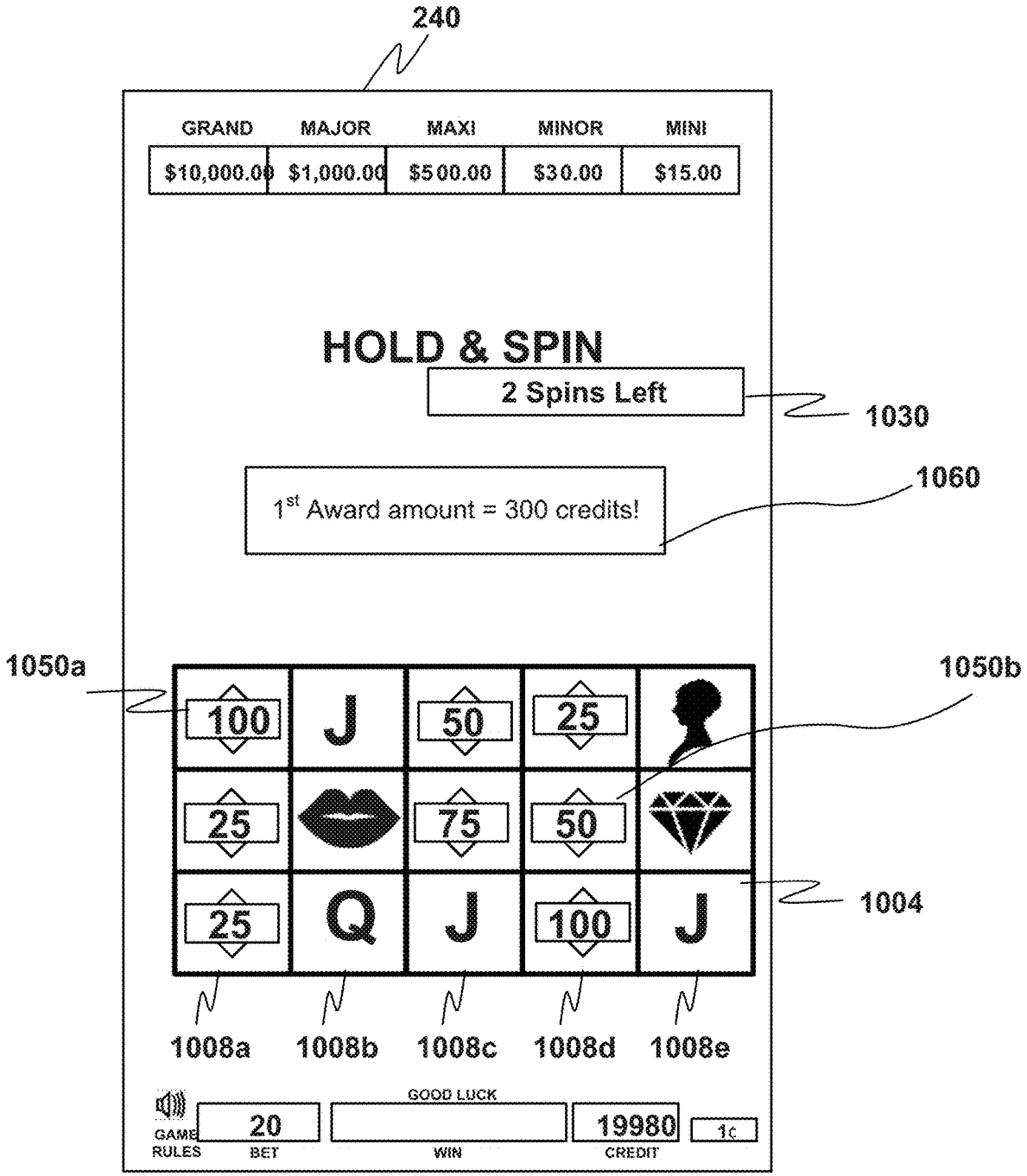

At 908, the award amount is displayed via at least one display of gaming device 200, such as shown in FIG. 10H. At 910, the gaming device 200 determines whether there are more additional configurable symbols in the feature game outcome. If there aren't any more additional configurable symbols, then the process for determining an award amount ends. Control may return to 834 and the play of the feature game may continue.

Figure 10I:
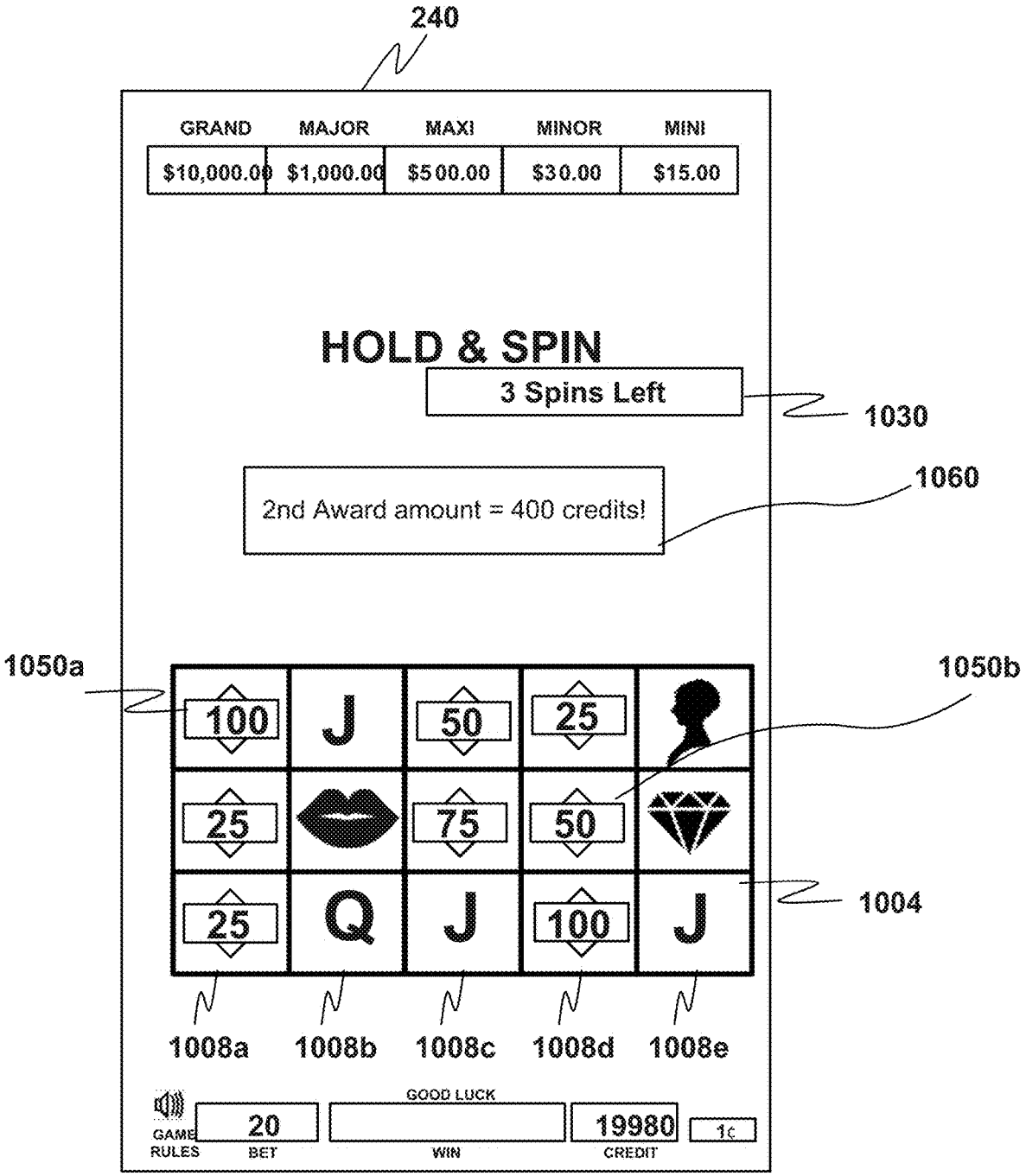

If there are more additional configurable symbols, such as in the example shown in FIGS. 10F-H, a second award is determined. At 912, the second award amount is determined by adding the value of the first award amount and the value of the first additional configurable symbol in the feature game outcome. In certain embodiments, the second award amount is determined by adding the value of the first award amount (that included the value of the first configurable symbol) and the value of the second additional configurable symbol in the feature game outcome. In certain embodiments, where one or more of the configurable symbols display a multiplier value, the multiplier may be applied to the award sum to determine the award value. In certain embodiments, where one or more of the configurable symbols displays a name of a jackpot, such as one of mini, minor, maxi, major or grand, the current value of that jackpot would be used for determining the award amount. If the configurable symbol from the previous feature game outcome displays a name of the jackpot, and that jackpot value is used to determine the first award amount, the jackpot value may either be reset to its default value for determining the second award amount, or be used as it was for the first award amount. At 914, the award amount is displayed via at least one display of gaming device 200, such as shown in FIG. 10I. Control returns to 910, where a determination is made by gaming device 200 whether there are any additional configurable symbols. In the example shown in FIGS. 10F-H, no additional configurable symbols were part of the feature game outcome, therefore the process for determining an award amount ends. Control may return to 834 and the play of the feature game may continue. In an outcome where there is a third additional configurable symbol, a third award may be determined, which may be based on the second award value and the value associated with the third additional configurable symbol.

Where there are two or more additional configurable symbols, there may be a determination made by gaming device 200 as to the order of using the additional configurable symbols for determining the award amount. In certain embodiments, the order may be based on the order of the symbol in matrix 1004, going left to right by the reels and then top to bottom. In certain embodiments, a random determination may be made. In yet other embodiments, the order may be based on the values associated with the configurable symbols, such as by lowest to highest, or vice versa. As will be appreciated by those skilled in the art, the order will affect the award amounts. For example, having a higher value symbol first will be advantageous from the perspective of the player, since it will be used to determine the first award amount, and therefore, used for subsequent award amounts for that feature game outcome.

FIGS. 10A to 10K represent screen shots of a display, such as the primary game display 240, at different phases during play of a base game and an ensuing hold and spin feature game according to some embodiments of the present disclosure. The game in these embodiments is illustrated as having a glamor theme, where the game symbols display glamor-related elements. In this regard, the non-configurable symbols may, for example, include people, watches, diamonds, lips, lipstick, ear rings, etc. (See, e.g. FIG. 10A). As in the prior embodiments, the configurable symbols 1102 are illustrated first as star shaped reveal symbols and then as a rectangle overlying a diamond (See, e.g., FIG. 10C-D). As discussed above, some embodiments may include multiple types of configurable symbols, such as value symbols, repeater symbols, mystery symbols, and/or jackpot symbols.

FIG. 10A to 10C illustrate the primary game display 240 during play of the base game. Briefly, the display 240 presents a game outcome using a 3×5 display matrix 1004, where each column represents a different reel 1008*a*, 1008*b*, 1008*c*, 1008*d*, 1008*e*. The reels 1008*a*-1008*e* are displayed as spinning and then stopping to present a matrix of display symbols representing a game outcome, as shown in FIG. 10C. The primary game display 240 also includes a credit meter display 1010 and a wager amount display 1012. While the examples of FIGS. 10A-K, show a matrix in a s 3×5, other embodiments where the symbol display positions may be arranged in a non-matrix arranged. Alternatively, the number of reels, the quantity of symbols positions per reel may be varied without departing from the scope of the present disclosure.

FIG. 10C illustrates the primary game display 240 after completion of a play of the primary game with the base game or primary game outcome. The base game outcome consists of six trigger symbols 1014. In this particular example, at least six trigger symbols are required to initiate the feature game. As described herein, once the feature game is triggered, the trigger symbols are replaced with configurable symbols. In certain embodiments, the trigger symbols are the configurable which reveal a value associated with each trigger symbol.

FIG. 10D illustrates the primary game display 240 after the initiation of the feature game. In this particular example, the feature game, which is a hold and spin game is initiated with 3 spins, as shown in spin counter 1030. The trigger symbols 1014 are replaced with configurable symbols 1014 that show the value associated with each of the trigger symbols 1014.

The game then transitions to the feature game. FIGS. 10E to 10J represent screen shots illustrating play of feature game that was triggered in FIG. 10C. The feature game is in the form of a hold and spin game in which any configurable symbols from the triggering base game outcome are retained on the display matrix 1004 and the player is awarded an additional number of spins (e.g., 3 in the illustrated example) during which the player tries to accumulate more of the configurable symbols. A spin meter 1030 may be displayed to indicate the number of spins remaining in the feature game.

FIG. 10E shows the display 240 during the first spin of the feature. As shown in FIG. 10E, the configurable symbols from the initiation of the feature game are held in their respective display positions, while replacement symbols for the other symbols (i.e., the non-configurable symbols) are selected. In certain embodiments, this is done by showing spinning reels, as seen in FIG. 10E. In certain embodiments, each symbol position in display matrix 1004 corresponds to a corresponding reel. To select replacement symbols, gaming device 200 selects a symbol from each of the reels that correspond to the non-configurable symbols. FIG. 10F shows the display following completion of the first spin (or instance) of the feature game. In this example, the player collected a total of 8 configurable symbols, including six during the triggering base game outcome and an additional two configurable symbols 1050 during the first spin of the hold and spin feature. In various embodiments, configurable symbols may not be displayed until after all the reels have stopped spinning. In some of these embodiments, another symbol may be shown while the reels are spinning and/or immediately after the reels have stopped. This symbol may be the trigger symbol used in the base game. The trigger symbol is then replaced with configurable symbols.

FIG. 10G shows the display 240 after the first spin of the feature game. Gaming device 200 determines that there one or more additional configurable symbols (two in this example) in the outcome of the first spin of the feature game. A message 1060 may be displayed on display 240. FIG. 10H shows the display 240 after a first award amount is determined and displayed on display 240. A message 1060 may be displayed on display 240. A first award is determined because there were two additional configurable symbols selected and displayed for the outcome of the first spin of the feature game. The first award is based on the values of the six configurable symbols 1014 that were selected and displayed at the start of the feature game (300 credits).

FIG. 10I shows the display 240 after a second award amount is determined and displayed on display 240. A message 1060 may be displayed on display 240. A second award is determined because there were two additional configurable symbols selected and displayed for the outcome of the first spin of the feature game. The second award is based on the first award amount (300 credits) and the value associated with the first additional configurable symbol 1050*a* (100 credits) for a total of 400 credits. Alternatively, the second award amount is based on the values of the six configurable symbols 1014 and the first additional configurable symbol. Since there are no more additional configurable symbols in the outcome of the first spin of the feature game, the first spin is over and the next spin is to be presented. The total award amount for this spin or instance of the feature game is the sum of the first award and the second award (700 credits). Since there was at least one additional configurable symbol in this spin, the spin counter 1030 is reset to the original count of 3. In the embodiment shown in the example FIGS. 10A-10K, the value of second additional configurable symbol is not awarded until a next spin or instances of the hold and spin game, where additional configurable symbols are selected and displayed.

Figure 10J:
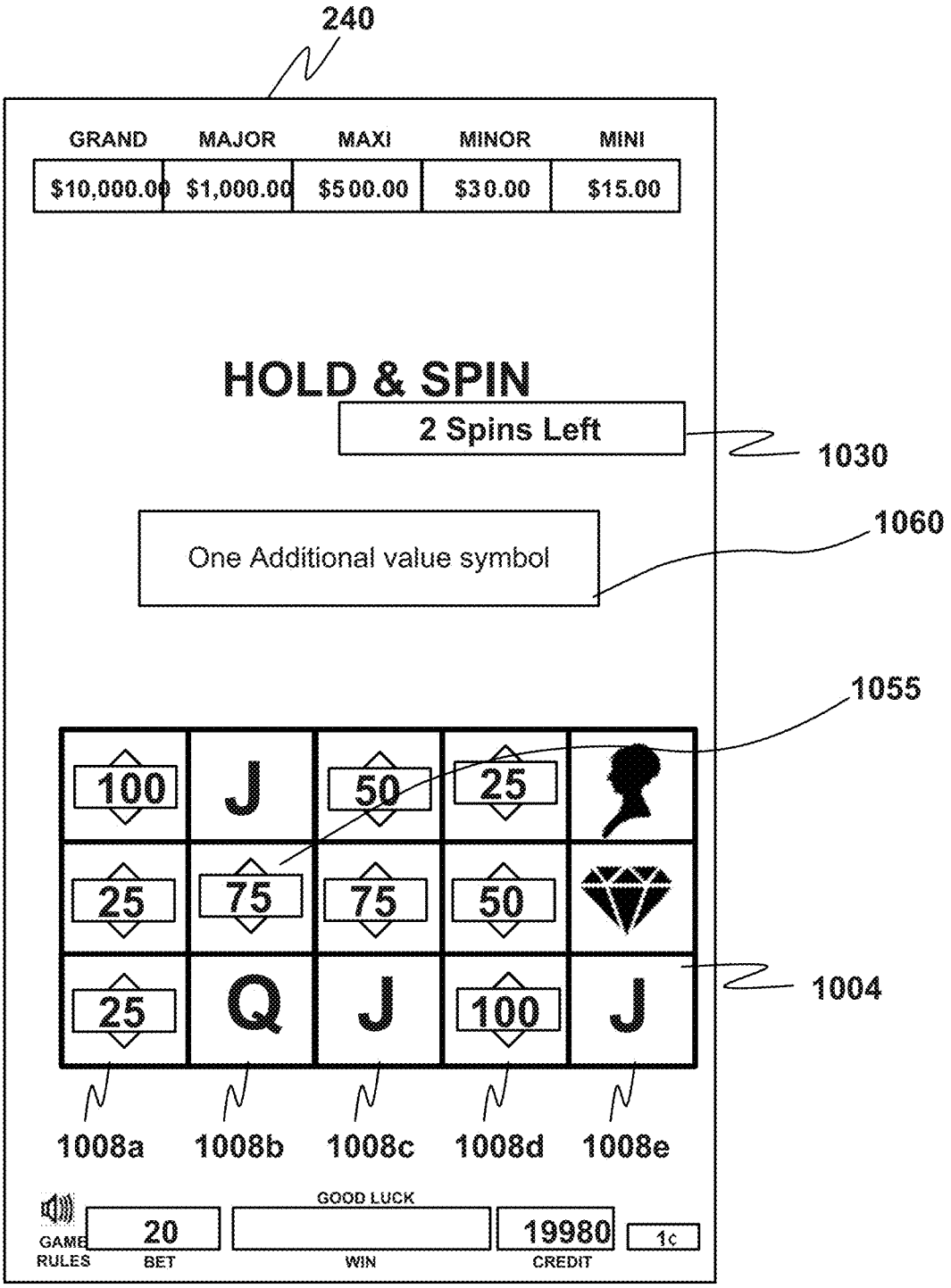
Figure 10K:
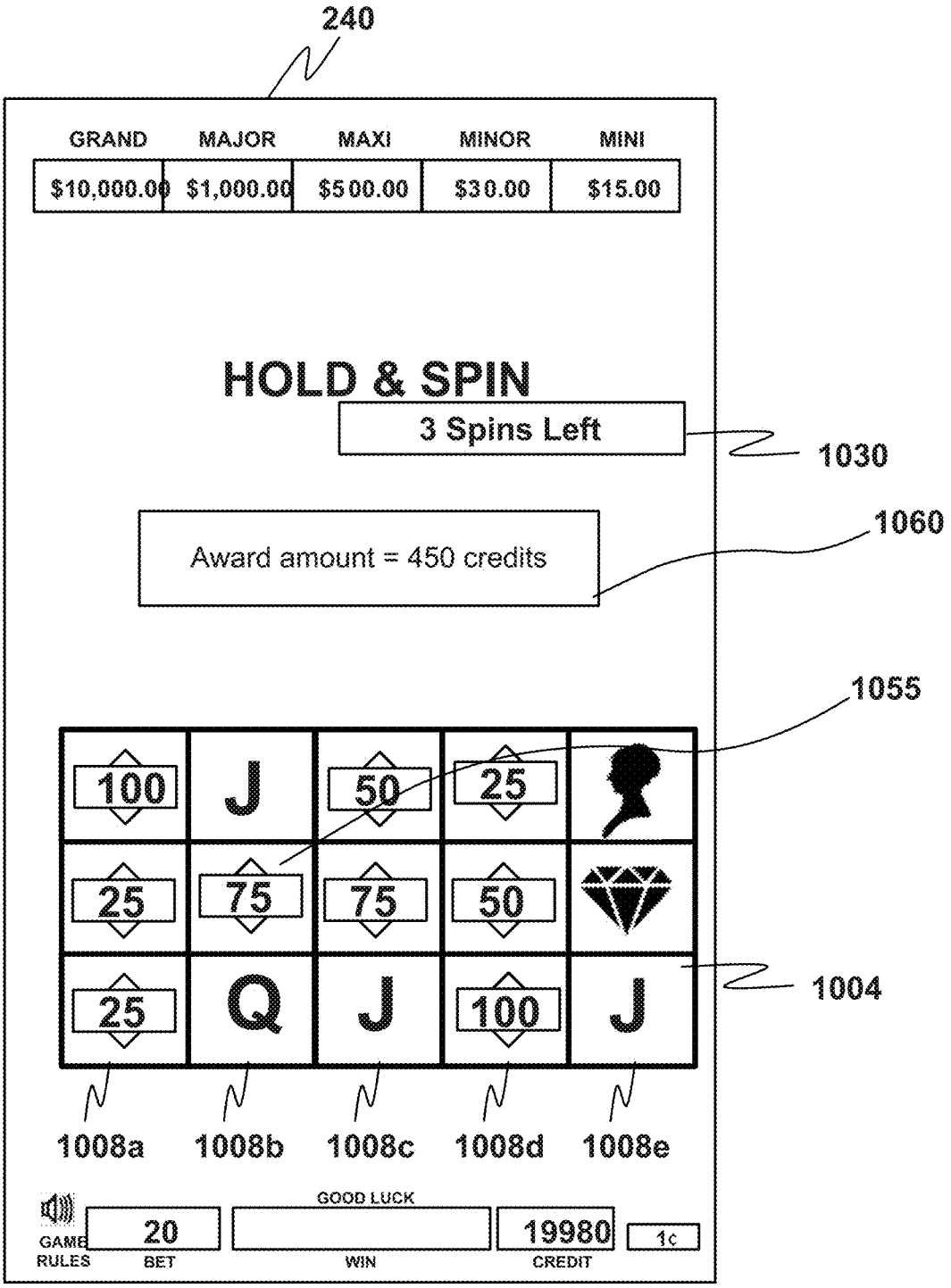

FIG. 10J shows the display 240 after the second spin of the feature game. All configurable symbols from the previous spin are held in their respective display positions and replacement symbols are selected for display positions that did not have the configurable symbols. Gaming device 200 determines that there one or more additional configurable symbols (one in this example) in the outcome of the second spin of the feature game. A message 1060 may be displayed on display 240. FIG. 10K shows the display 240 after a first award amount is determined and displayed on display 240. A message 1060 may be displayed on display 240. A first award is determined because there was one additional configurable symbol selected and displayed for the outcome of the second spin of the feature game. The first award is based on the values of the eight configurable symbols that were selected and displayed at the end of the first spin of the feature game (450 credits). The spin counter 1030 resets back to 3 and play of the feature game continues until the spin count is 0 or all of the symbol display positions are filled with configurable symbols. Once the feature game is completed, in this example the controller determines and pays out a feature game award which is the sum of the awards for each spin of the feature game.

An animation may be provided to visually display the credits from the held symbols being accumulated on a credit meter 1140 before the display matrix 1004 is cleared. For example, an animation may display rockets (not shown) or other elements sequentially moving from each respective configurable symbol to the credit meter 1140. When a respective rocket reaches the meter, it may explode and the value from the originating configurable symbol may be added to the prize meter. When a multiplier is applicable, the animation may be repeated, e.g., twice for a 2× multiplier, three times for a 3× multiplier, etc. The award meter 1140 may show the collected credits or the cash equivalent to the collected credits.

In various embodiments, a trigger event may increase the prize values associated with (a) any displayed and held configurable symbols; (b) configurable symbols for the current spin of the feature game; and/or (c) configurable symbols for one or more future spin. This trigger event may be random, based on a symbol or symbol combination, etc. In certain embodiments, the trigger event is based on additional configurable symbols being selected during any outcome of the feature game. In one of the these embodiments, the random boost occurs once per outcome, where one or more additional configurable symbols are selected. In another embodiment, the random boost occurs multiple times per outcome, based on the quantity of additional configurable symbols being selected.

In various embodiments, where no additional configurable symbols are selected during any of the rounds or spins of the feature game, an award is provided at the end of the feature game which equals the sum of values of the configurable symbols that triggered the feature game.

In various embodiments, the display matrix 1004 may be different for the play of the base game than for the feature game. In various embodiments, the symbol set for the base game may differ from the symbol set for the feature game. For example, the base game symbol set may include other traditional symbols used as non-configurable symbols, whereas the feature game symbol set may only have configurable symbols and one type of non-configurable symbol, such as a blank symbol.

Figure 11A:
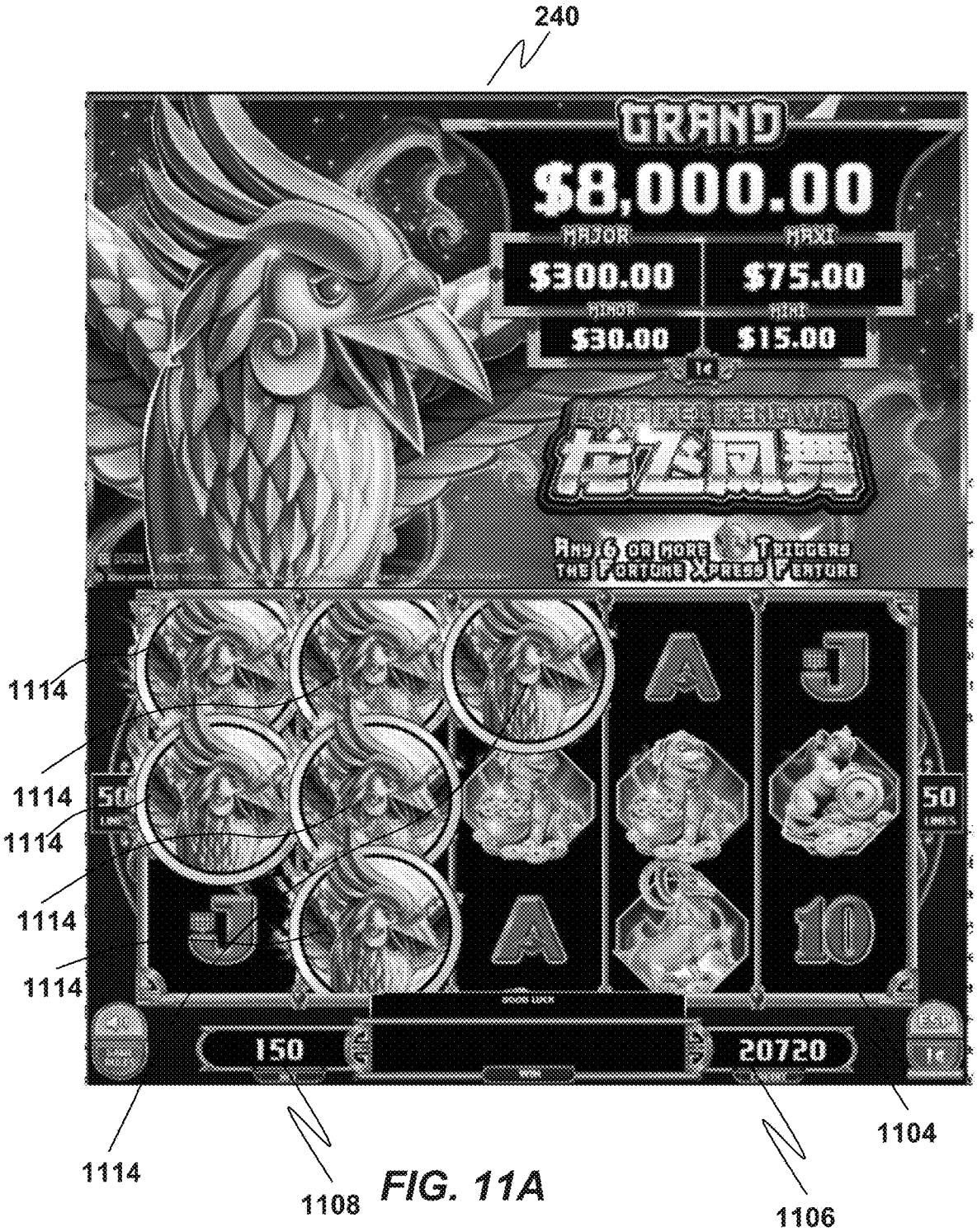
FIGS. 11A to 11H represent screen shots illustrating certain aspects of embodiments of the present disclosure.

FIGS. 11A to 11K represent screen shots of a display, such as the primary game display 240, at different phases during play of a base game and an ensuing hold and spin feature game according to some embodiments of the present disclosure. FIG. 11A shows the display 240 with a base game outcome on matrix 1104. Credit meter 1106 shows the current credit balance. Wager amount 1108 shows the currently wagered amount (150 credits, times the 1c denomination). The base game outcome includes 6 trigger symbols 1114, thereby triggering the feature hold and spin game.

Figure 11B:
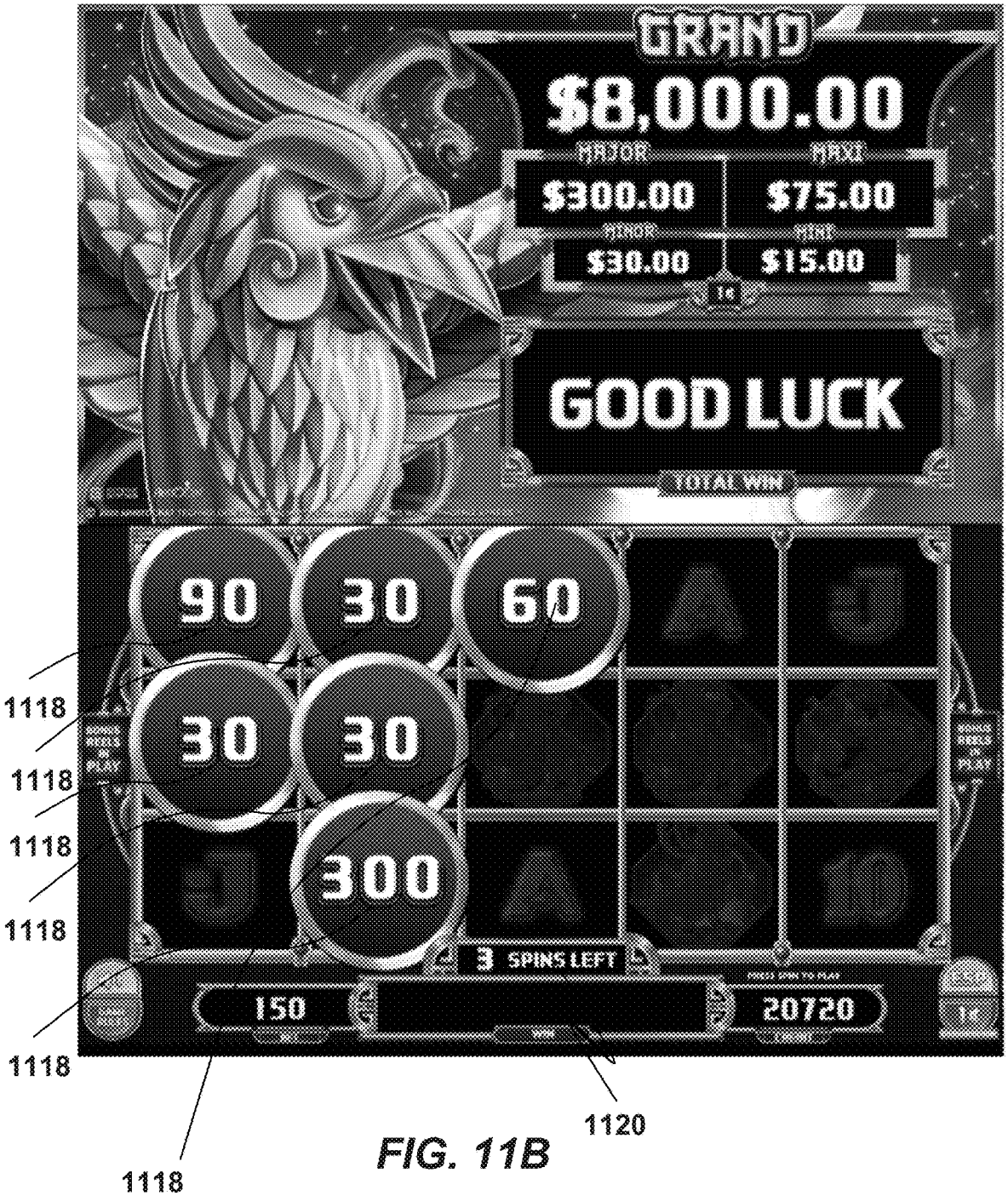
Figure 11C:
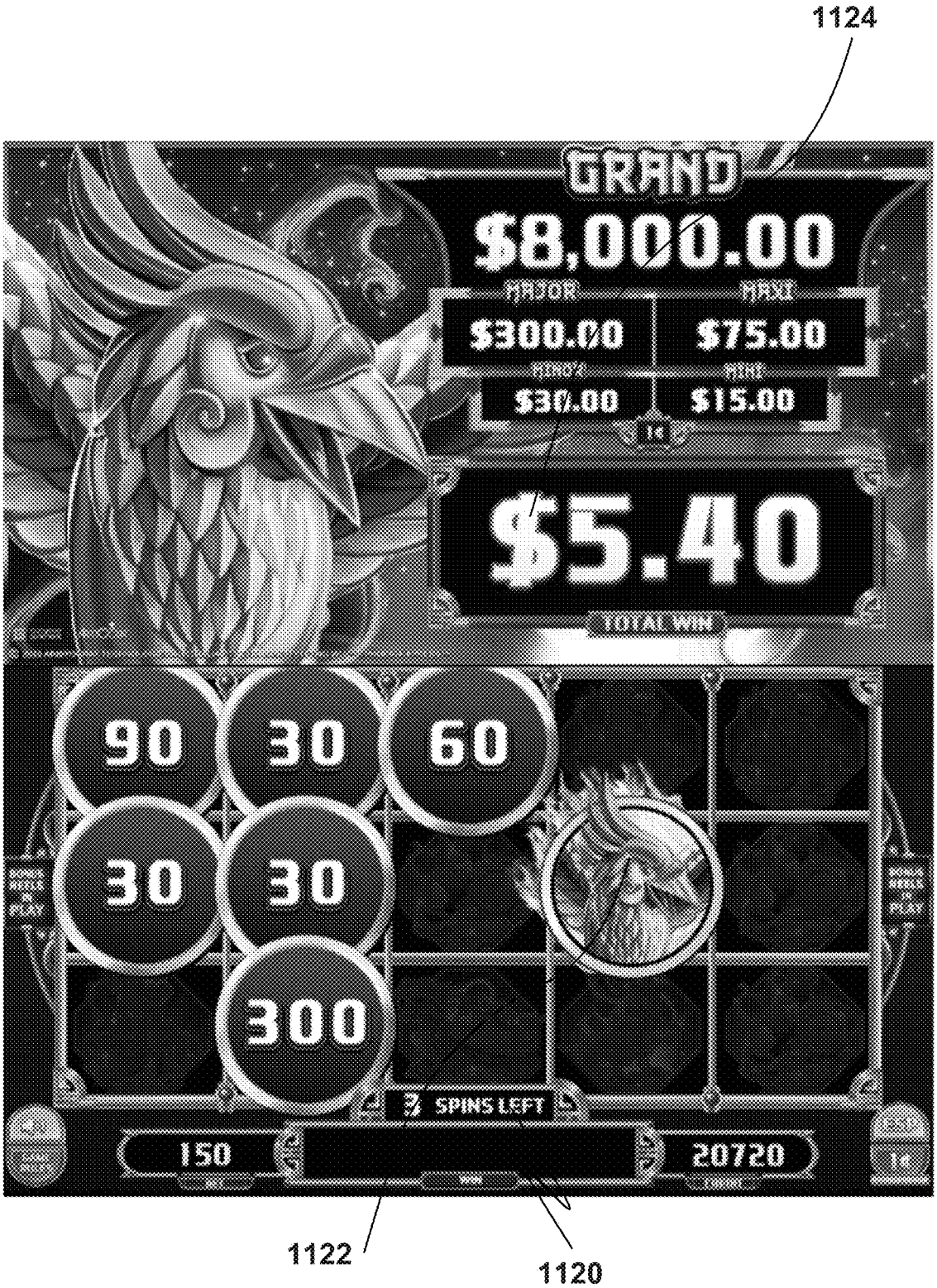

FIG. 11B shows the display 240 after the feature game is triggered. Trigger symbols 1114 are replaced by configurable symbols 1118, each having a respective award value. Remaining spin count 1120 shows that the feature game has 3 spins remaining. FIG. 11C shows the display 240 with a feature game outcome or instance after the first spin on matrix 1104. The feature game outcome includes one additional configurable symbol 1122 (shown without the award value). Since there is at least one additional configurable symbol 1122 in the outcome, an award amount is determined for this outcome or instance, based on the six configurable symbols that were selected and displayed at the start of the feature game (90+30+30+30+300+60=540 credits, or $5.40 at 1c denom). This amount is added to the feature award meter 1124 (which was 0 prior to this outcome).

Figure 11D:
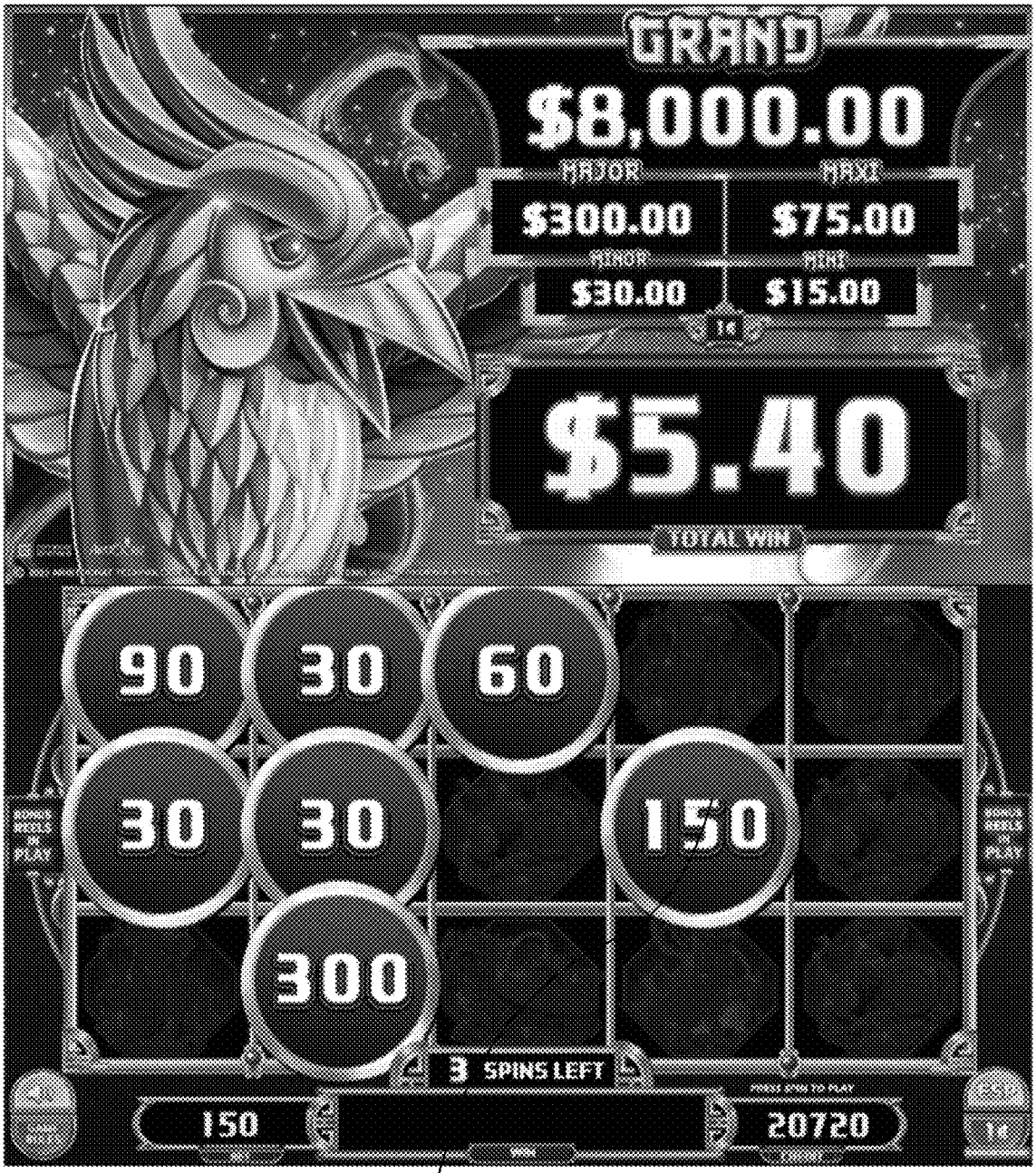
Figure 11E:
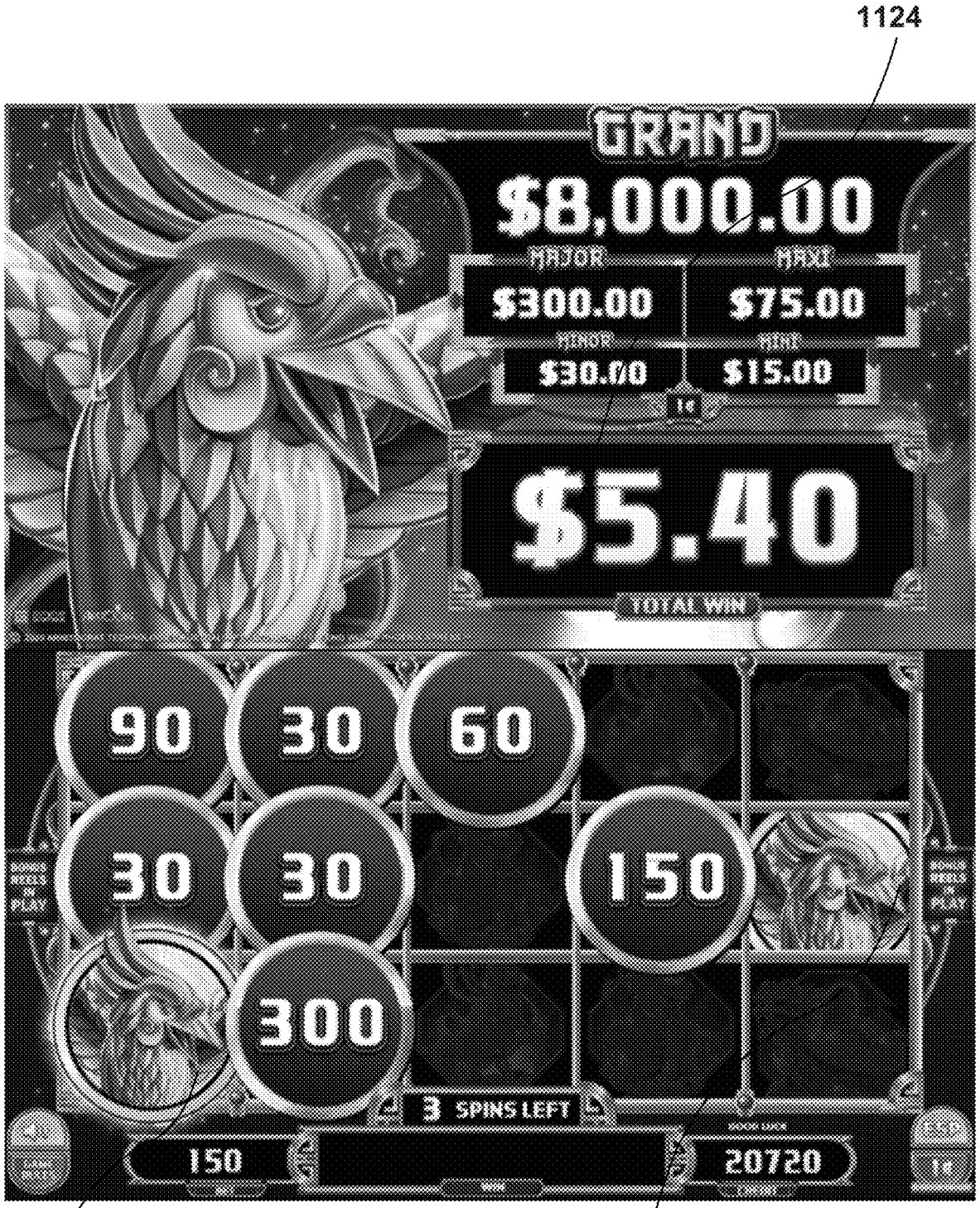
Figure 11F:
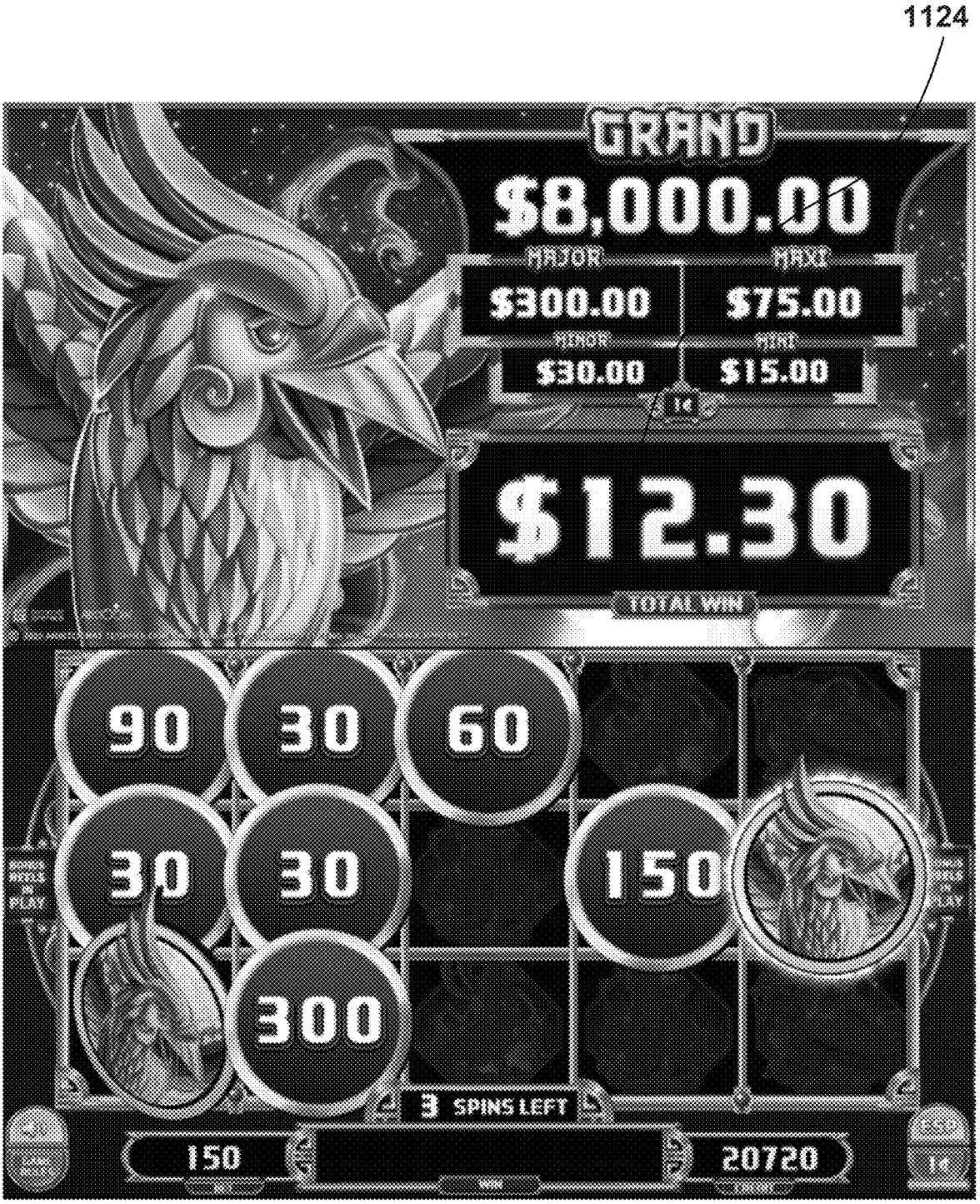

FIG. 11D shows the display 240 with the feature game outcome or instance after the first spin on matrix 1104, with the value of the additional configurable symbol 1126 being displayed. FIG. 11E shows the display 240 with the feature game outcome or instance after a second spin on matrix 1104. In the outcome of the second spin, two additional configurable symbols 1128 and 1130 are selected and displayed. All the configurable symbols from the previous spin are held in their respective display positions for this spin and future spins. Since there are two additional configurable symbols in this instance, two award amounts will be determined by the gaming device 200. FIG. 11F shows the display 240 with the feature game outcome or instance after the second spin on matrix 1104, with the first award amount determined. The first award amount is based on seven configurable symbols that were selected and displayed at the prior to the current spin or instance (90+30+30+30+300+60+150=690 credits, or $6.90 at 1c denom). This is added to the feature award meter (which was $5.40 prior to this outcome) for a total of $12.30, as displayed on feature award meter 1124.

Figure 11G:
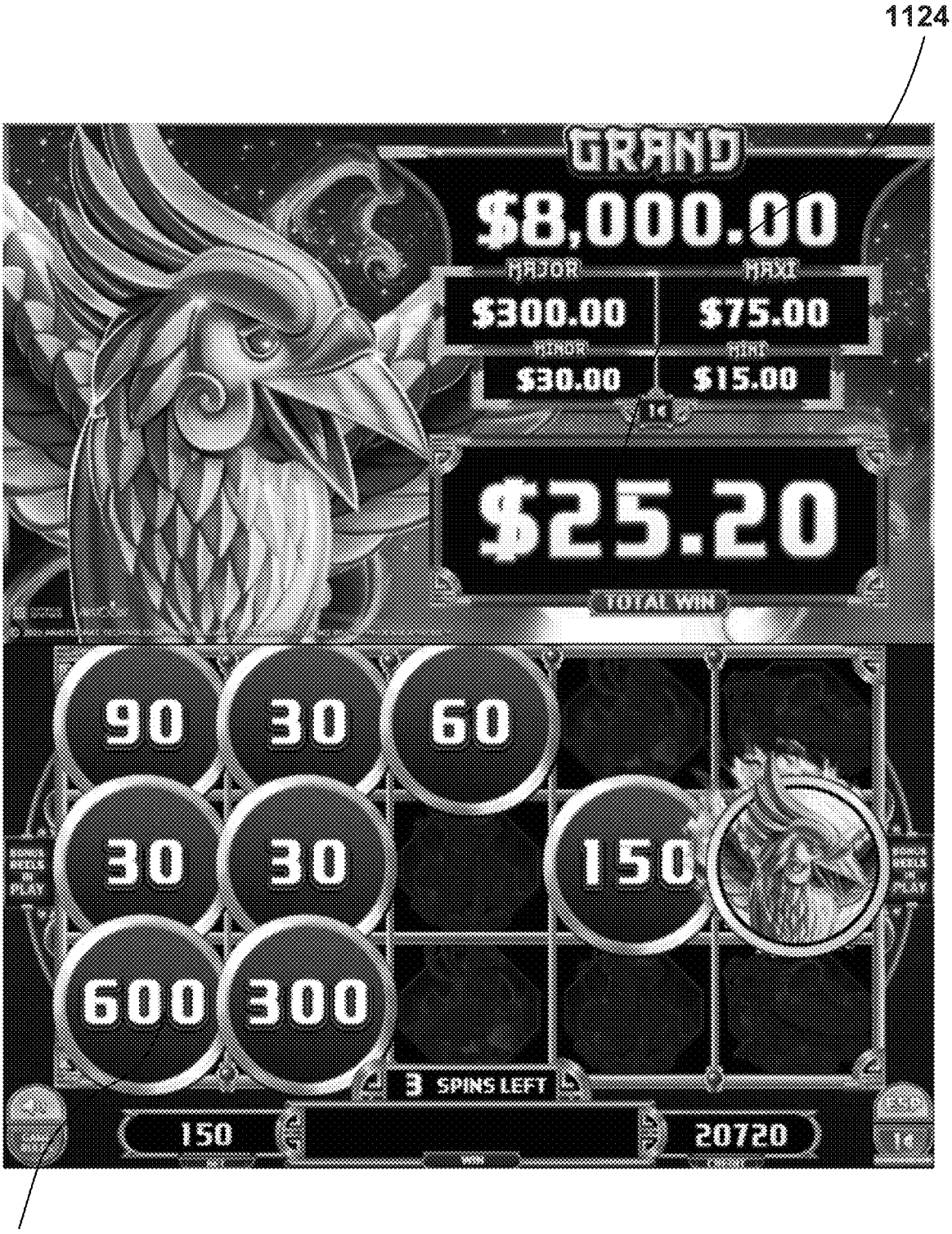
Figure 11H:
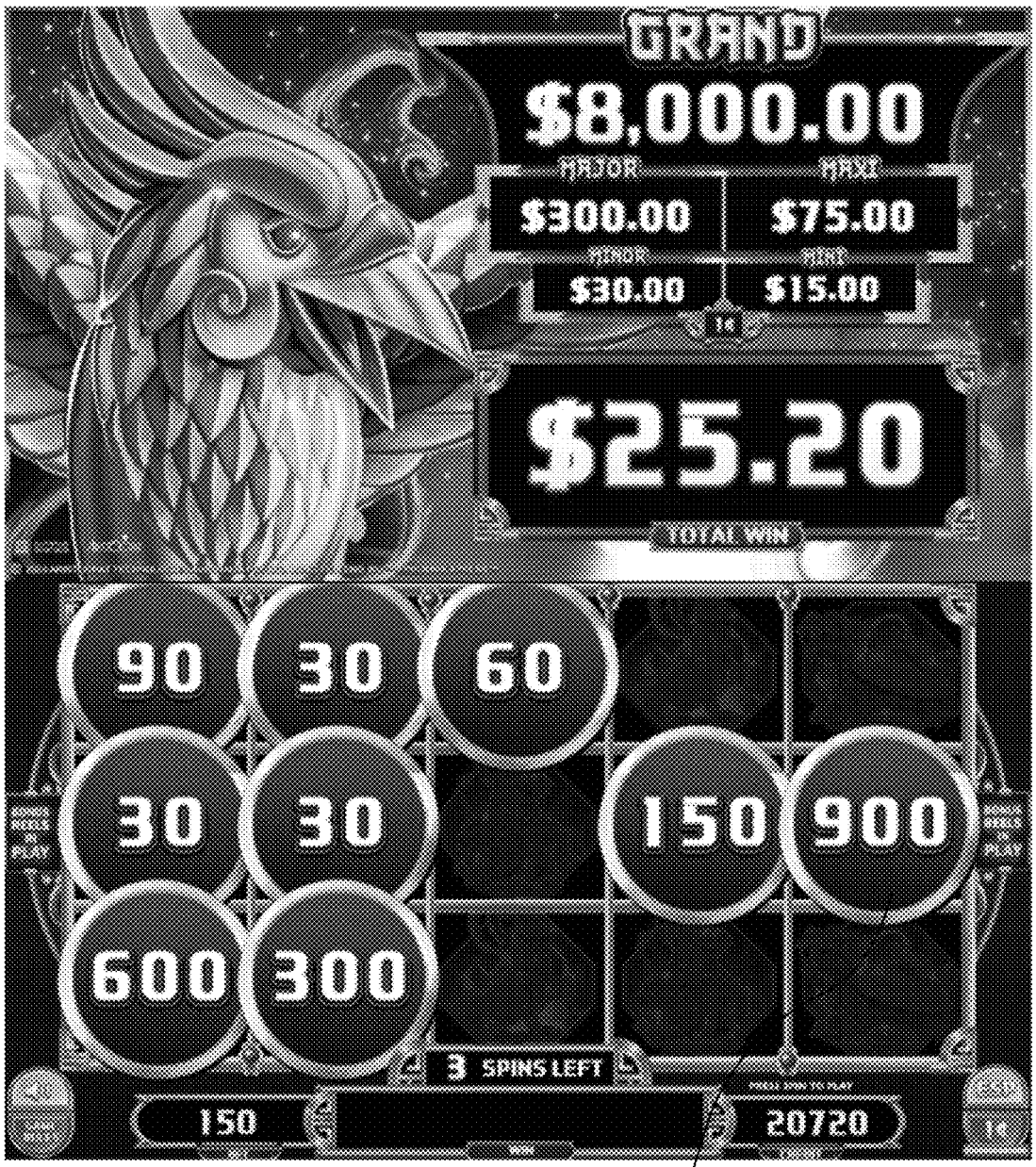

FIG. 11G shows the display 240 with the feature game outcome or instance after the second spin on matrix 1104, with the second award amount determined. The second award amount is based on seven configurable symbols that were selected and displayed at the prior to the current spin or instance (90+30+30+30+300+60+150=690 credits) and the first additional configurable symbol 1128 which is now replaced to reveal its associated value 1132 (600 credits) for a total of 1290 credits, $12.90 at 1c denom. This is added to the feature award meter (which was $12.30 prior to this outcome) for a total of $25.20, as displayed on feature award meter 1124. FIG. 11H shows the display 240 with the feature game outcome or instance after the second spin on matrix 1104, with the value of the additional configurable symbol 1130 being displayed.

In certain embodiments, a volatility option may be provided to the player. The volatility option may include a quantity of picks that may vary the volatility of the hold and spin feature round. The player selects (usually) one pick from the multiple picks to play the hold and spin feature game. The selected pick will be used to determine the features of the hold and spin feature game, as discussed herein. The hold and spin feature round may include one or more features, in accordance with the various embodiments described in the present disclosure. In some embodiments, the hold and spin game may include the iterative awards as describe be various embodiments. In various other embodiments, the hold and spin feature game may be played out as shown in FIGS. 6A-6B or FIGS. 7A-7B.

The volatility option may be provided prior to the start of the hold and spin feature game. For example, in the embodiment of FIGS. 8A-8B, the volatility option is provided to the player after determining that the feature has been triggered at 814 and prior to determining trigger symbol value at 816. It may also occur prior to generating the feature game outcome for the instance at 824.

The picks that form the volatility option may include one, two, or more varying options. For example, the picks may include options such as a: Multiplier 1×, 4-3-2-1 hold and spin; b: Multiplier 2×, 3-2-1 hold and spin; c: Multiplier 5×; 2-1 hold and spin; d: Multiplier 10×; 1 hold and spin. The multiplier applies to any awards from the hold and spin game. The 4-3-2-1 signifies that there will be 4 initial spins of the hold and spin game, starting from 4. When additional configurable symbols are in outcome of any spin or instance, the remaining game count is reset to 4. Similarly, the 1 hold and spin (option d) signifies that only 1 initial hold and spin round is provided. If there is no additional configurable symbol in that 1 outcome, the game will end.

Those skilled in the art will recognize that the amount of the multiplier may be varied without departing from the scope of the disclosure. Further, instead of using a multiplier, a different option may be used, such as random wilds, wild reels, prize boost, etc.

In some embodiments, one or more additional enhancing reels may be provided to enhance the player's chances of triggering the feature game and/or a resulting feature game award. For example, some embodiments may include an additional reel that may be selectively activated during play of the base game. In certain embodiments, the player may activate the additional reel by placing an additional wager, e.g., an ante bet, in connection with play of the base game. In some embodiments, the ante wager may, for example, be a fixed dollar or credit amount. In other embodiments, the ante wager may be a determined percentage (e.g., 50%, 75%, or 100%) of the base game wager.

The additional reel may provide for additional configurable symbols that increase the frequency and value of the hold and spin feature game. In some embodiments, the extra reel may contain only configurable symbols and blank symbols. In some embodiments, the extra reel may contain only configurable symbols. In some embodiments, in addition to the configurable symbols, the extra reel may contain high value symbols, scatter symbols, wild symbols, or any combination of these. When purchased, the extra reel may spin and work with the base game reels to trigger the feature game in the manner described above. In some embodiments, when the extra reel is not purchased, it remains stationary or is not displayed during base game play. In other embodiments, the extra reel may still spin when it is not purchased but it does not work with the base game reels, e.g., to trigger the feature game.

In some examples, an extra reel may include one or more multiplier symbols. According to some such examples, the extra reel may have a corresponding multiplier meter. In some such examples, the multiplier meters may be adjusted (e.g., increased or decreased) during play of a base game, e.g., according to the multiplier symbols. According to some instances, the multiplier meter values may be used to determine a feature game award when a feature game is triggered and completed.

In various embodiments, the base game may use any number of extra reels (e.g., 2, 3, 4 or 5 extra reels), charge any amount for each extra reel (e.g., 50% of the base game wager), put any number or type of symbols on an extra reel (e.g., only value symbols with jackpots), change symbols from spin to spin (e.g., value symbols may increase in value every 20 spins), and work with base game reels at any frequency (e.g., activates without ante bet every other spin).

In various embodiments, the size of the matrix for the play of the feature game and/or the base game may increase or decrease based on certain trigger conditions. For example, the play of the feature game may include certain trigger symbols that trigger the increase and/or the decrease of the matrix, or certain reels. For example, a reel growth trigger symbol, when selected, may increase the reel height of certain reels, such as reels 2, 3, and 4. In some embodiments, the reel growth trigger symbol may only occur during the play of the feature game. In some embodiments, the reel growth trigger symbol may only occur on certain reels, for example reel 1. Further, in some embodiments, the reel growth trigger symbol may be considered as a configurable symbol, such that it may be assigned to certain configurable symbol prior to the reels spinning for the next play of the base and/or feature game. Additionally, the reel growth trigger symbol, when occurring during the play of the feature game, may be held in place for the remaining plays of the feature game. In some embodiments, in addition to functioning as a trigger for reel growth, the reel growth trigger symbol may also have an assigned value, multiplier, additional spins, etc.

In some embodiments, the feature game may provide multiple game instances, i.e., multiple symbol matrices. In some embodiments, multiple game instances may be provided only when a second trigger condition occurs in connection with the triggering of the feature game. In some embodiments the second triggering condition may be an ante bet, which is placed in addition to the base game wager. In some embodiments, the number of additional game instances in the feature game is dependent on the size of the ante bet. For example, a first ante bet may result in two game instances, a second, larger ante bet may provide three game instances, etc.

In some embodiments the ante bet is placed prior to play of the base game. In other embodiments, the option to place the ante bet may be made available at other times, such as upon triggering the feature game.

In at least some embodiments, the multiple game instances are played independently from one another. For example, in the context of a hold and spin feature game, each of the game instances may consist of a respective set of reels that spin independently of the reels in the other game instance(s). In at least some embodiments, the game instances are played simultaneously. For example, in the context of a hold and spin feature game, the reels in all of the matrices may be spun at the same time in a given round. In other embodiments, the game instances may be played sequentially during the feature game.

In various embodiments, the additional game instances replicate at least some of the symbols from the base game outcome that triggered the feature game. In certain embodiments, the additional game instances initially replicate at least some of the configurable symbols that triggered the feature game. In some embodiments, the additional game instances replicate all of the configurable symbols that triggered the feature game.

In embodiments where the feature game is a hold and spin feature game, an ante bet may entitle the player to multiple game instances upon the feature game being triggered. For example, the ante bet may result in one or more additional game instances (i.e., display matrix) that each initially include at least some of the configurable symbols that triggered the feature game. In certain embodiments, the triggering base game outcome is fully replicated such that the hold and spin feature begins with at least two identical display matrices that may be played independently during the hold and spin feature game. In particular, separately for each game instance, the configurable symbols in a respective game instance are held in place while any non-configurable symbols are replaced with a symbol selected from the set of configurable and non-configurable symbols.

In some embodiments, the game may replicate and re-replicate any number of times (i.e. 1 game replicates 2 times and then another 3 times) according to the same or varied triggering conditions. For example, a base game replicates one time upon the appearance of any six or more scatter symbols and, as a result, provide two independent games. Each of these two games may then replicate again upon the appearance of any one or more special scatter symbols. This re-replication process may occur indefinitely or cease upon reaching a predetermined number of games.

In some embodiments, the game may include any number or type of symbol from the original game in the replicated game(s) (e.g., only replicates the highest value symbols).

In some embodiments, the base and replicated games may play independently (as illustrated in prior embodiments) or dependently (i.e. only plays the first replicated game if the base game collects 12 or more held symbols).

In certain embodiments, the values for the configurable symbol are dependent on the quantity of configurable symbols in the base game outcome that triggers the feature game. For example, if six symbols are needed to trigger the hold and spin feature game, if the base game outcome includes six symbols, the values associated with the configurable symbols in the feature game set may be selected from a first set of values. If seven symbols are in the base outcome that triggers the hold and spin feature game, then the values of the configurable symbols in the feature game set may be selected from a second set of values. In one or more embodiments, some or all of the values in the second set of values may be greater than some or all of the values in the first set of values.

In some embodiments, the trigger event to trigger the hold and spin feature may occur over a quantity of base game spins. For example, the gaming device 200 may accumulate trigger symbols over a quantity of base game outcome and then trigger the feature game, when the quantity accumulated exceeds a threshold quantity.

In some embodiments, the configurable symbols may include repeater symbols whose value is not determined until a feature game is triggered. In an embodiment, the value of the repeater symbol is generated based on the value(s) of one or more of the configurable symbols that trigger a respective feature game. In an embodiment, the value of the repeater symbol is determined by summing the values of the configurable symbols that trigger a respective feature game. For example, in an instance where a feature game is triggered by configurable symbols having values of 10 credits, 10 credits, 10 credits, 20 credits, 20 credits, 50 credits, 40 credits, and the repeater symbol's value would be 160 credits. Any repeater symbols that spin up during the ensuing feature game would be set to 160 credits in this example.

In some embodiments, the value of the repeater symbols may change across feature spins: i) at random, ii) according to defined table/order, iii) based upon results of a feature spin, iv) wager level, v) number of initiating feature initiating symbols, vi) number of symbols collected in feature, vii) based upon the combined result of multiple players game events, wager level or other criteria across multiple linked gaming units (i.e. progressive repeater value), and/or viii) any combination of the foregoing.

In some embodiments, the configurable symbols may include mystery symbols whose value is not revealed at the time the mystery symbol is displayed. In an embodiment, the value of a mystery symbol may be determined, e.g., randomly, and any time following its display. The mystery symbol may then be modified to display its determined value.

In some embodiments, mystery symbols may be displayed in connection with play of both the base game and the feature game. Accordingly, in some embodiments, it is possible for a mystery symbol to be part of the defined number of triggering symbols in a base game. For example, a base game result could include a mystery symbol along with five other configurable symbols. In such instance, the value of the mystery symbol may be determined and displayed prior to determining the value of the repeater symbol. If additional mystery symbols are awarded during the assigned value ensuing feature game, the value could be assigned this same value or other values may be separately determined.

In some embodiments, the value of a mystery symbol may be determined and awarded to the player during play of the base game if the base game outcome does not trigger the feature game. For example, assuming 6 configurable symbols are required to trigger a feature game, the appearance of a mystery symbol in a base game outcome with fewer than 6 configurable symbols may result in the award of the determined mystery symbol value to the player even though the feature game would not be triggered.

In some embodiments, the awards assigned to mystery symbols may be selected from a set of awards that includes (1) credit values, e.g., 10 credits, 20 credits, 50 credits, 100 credits, 500 credits, etc., (2) jackpot values, e.g., MINI, MINOR, MAXI, and GRAND, and/or (3) fixed prizes, e.g., cars, electronics, etc. In some embodiments, the awards assigned to mystery symbols during the base and feature games may be selected from the same set of possible awards. In some other embodiments, different sets of possible awards may be available during the base and feature games. For example, in some embodiments, the mystery symbol awards may be limited to jackpot awards and/or fixed prizes during the base game, while the possible awards during the feature game may also include credit values.

In some embodiments, a first valuation game may be provided to determine the value of the mystery symbols. The first valuation game may be in the form of a first spinning wheel game, where a wheel spins and randomly stops to determine a value for one or more mystery symbols. The wheel may include of a plurality of sections that each display a respective value, such as a numeric value (e.g., a number of credits or currency), or jackpot label (e.g., mini, minor, major maxi, or grand) that is associated with a jackpot amount (e.g., $50, $500, $1,000, $5,000, $10,000). The wheel may, for example, spin vertically or horizontally across a game screen forming part of the slot machine device.

In some embodiments, a single wheel spin may be used to determine the value for any displayed mystery symbols. For example, where the triggering base game outcome has four value symbols and three mystery symbols, the first valuation game is triggered. If the first valuation game results in a value of $100, then each of the three mystery symbols are converted from a question mark symbol to $100.

In other embodiments, the wheel may be separately spun for each displayed mystery symbol. Accordingly, in some embodiments, the example may result in three wheel spins (one for each mystery symbol) during the first valuation game.

In various embodiments, the first valuation game may not display a wheel, but instead may display the values in a different arrangement such as a reel, a grid, etc. In certain embodiments, the first valuation game may not display a wheel, a reel, or values and instead may make a random determination to select one value from a range or group of values and display the selected value and use it for the one or more mystery symbols.

In various embodiments, one or more mystery symbols may be replaced with a sum of the values of symbols displaying a value. In other embodiments, the value of the mystery symbols may be set in other ways. For example, a random event may cause a value to be set on a mystery symbol. Also, there may be a player skill feature where the skill level of the player is determined or is based on particular data regarding the particular player, and the value of the mystery symbol is set accordingly. Also, pick n' pop may be used to set the value of the mystery symbol.

Also, different levels of mystery symbols may be used, such that some levels are of higher average values than others. For example, blue mystery symbols may use a blue wheel with lower average values and gold mystery symbols may use a gold wheel with higher average values.

The first valuation game may also be used to determine the value of any additional mystery symbols that are collected during the feature game. In some embodiments, the first valuation game may be triggered following any spin that produces one or more new mystery symbols. Alternatively, the first valuation game may be conducted upon completion of the feature game. As discussed above, a single spin may be used to determine the value of all newly awarded mystery symbols. Alternatively, individual spins may be conducted to separately determine the value of each respective mystery symbol.

In some embodiments, an enhanced award may be awarded if the display matrix is completely filled with configurable symbols during the Hold & Spin feature game. For example, in some embodiments, the enhanced award may be a multiplier, such as a 2× or 3× multiplier of the "hold" symbols, or an award of a jackpot value.

In some embodiments, the enhanced award may be determined using a second valuation game. The second valuation game may be a second spinning wheel game that provides different and/or enhanced values from those used in the first spinning wheel game. For example, the second spinning wheel game may include multipliers (i.e. 2× or 3×) or multipliers with jackpots (i.e. 2×+Grand or 3×+Major). The multiplier value indicated by the spin of the second display wheel affects the sum total value of all "hold" configurable symbols collected in the Hold & Spin game (i.e. "2×" will double the sum total value); the jackpot enhances the Hold & Spin award by the amount of the jackpot (i.e. $50, $500 or $5000 will be added to the sum total value).

In some embodiments, the base game symbol set comprises non-configurable symbols and feature trigger symbols. In some embodiments, the feature game symbol set comprises configurable symbols and blank symbols.

Those of ordinary skill in the art will appreciate that (1) the number of configurable symbols required to trigger the feature game; (2) the number of feature games awarded; (3) number of decrements of feature game counter; (4) the number of configurable symbols that have to be displayed to win a prize or jackpot in the feature game; (5) the multiplier to apply; (6) the value of the mystery symbol; (7) the additional quantity of spins; (8) the prize value of the configurable symbols; (9) the number of increments or decrements of the progressive free spin counter; (10) the value of the multiplier on the multiplier symbol; (11) the value on the value symbols; (12) the number of extra reels; or (13) any other determination or variable described or contemplated in the present disclosure may at least in part be (a) randomly determined; (b) predetermined; (c) determined based on a wager amount and/or level; (d) centrally determined; (e) determined based on a generated symbol or symbol combinations; (f) determined based on player selection; (g) determined based on player skill; (h) determined based on a side wager or ante bet; (i) determined based on a status of the player; (j) determined as a combination of two or more determinations disclosed herein; etc. Further, those of ordinary art will appreciate that one or more aspects of the disclosure, as described herein, may be combined with another one or more aspects of the disclosure.

As will be appreciated by those skilled in the art, the present disclosure embodies various improvements. For example, those that play gaming devices 200 are always looking for a more engaging experience as well as an experience that provides a fair balance between payout and entertainment. Additionally, they prefer interfaces and UIs that provide a simpler mechanism to communicate various game events. Use of configurable symbols to display and determine award values, provides a level of simplicity from a user interface perspective that is not commonly found in gaming devices. Further, the ability to hold configurable symbols for a chance of a higher payout provides a more engaging experience. Furthermore, the ability to receive iterative awards using previously held configurable symbols is an added benefit to the players. The use of configurable symbols on reels as the reels are spinning requires higher graphics processing power, this is reduced by showing a mystery symbol or a configurable symbol without the values on the reels as the reels are spinning. The mystery symbol or configurable symbol is common across all reels and thereby is a lesser graphic load to present while spinning than configurable symbols with different values.

It is to be understood that, if any prior art is referred to herein, such reference does not constitute an admission that the prior art forms a part of the common general knowledge in the art in any country.

In the claims which follow and in the preceding description, except where the context requires otherwise due to express language or necessary implication, the word "comprise" or variations such as "comprises" or "comprising" is used in an inclusive sense, i.e., to specify the presence of the stated features but not to preclude the presence or addition of further features in various embodiments of the disclosure.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A gaming device comprising:

a display system comprising one or more display devices; and a control system comprising one or more processors and a memory storing a base game symbol set, a feature game symbol set comprising configurable symbols and non-configurable symbols, and instructions, which, when executed, cause the control system to:

control the display system to animate a base game outcome having symbols selected from the base game symbol set based on a random number generated from a random number generator, control the display system to animate a feature game having a first quantity of instances being played simultaneously, when the symbols selected comprise at least a quantity of trigger symbols, control the display system to replicate the base game outcome that includes the quantity of trigger symbols in the first quantity of instances being played simultaneously, control the display system to animate a plurality of feature outcomes for the first quantity of instances simultaneously having feature game symbols selected from the feature game symbol set, control the display system to hold a displayed configurable symbol at a corresponding display symbol position for each of the first quantity of instances of the feature game being played simultaneously, and in response to the feature outcomes displaying at least two additional configurable symbols, control the display system to animate a first award amount based on values of the configurable symbols held from previous instances, followed by a second award amount based on the first award amount and one of the at least two additional configurable symbols.

2. The gaming device of claim 1, wherein the instructions, when executed, further cause the control system to, for a respective instance of the feature game, determine that a respective feature outcome for the respective instance includes one configurable symbol; and in response to determining that the respective feature outcome for the respective instance includes one additional configurable symbol, determine a third award amount based on values of the configurable symbols held from previous instances.

3. The gaming device of claim 1, wherein the instructions, when executed, further cause the control system to control the display system to:

replace the trigger symbols with configurable symbols prior to presenting the feature game; and hold each displayed configurable symbol at its corresponding display symbol position for all instances of the feature game.

4. The gaming device of claim 3, wherein each of the configurable symbols display a value corresponding to that configurable symbol.

5. The gaming device of claim 1, wherein one of the at least two additional configurable symbols is one of: a randomly selected configurable symbol from the at least two additional configurable symbols, and a first configurable symbol from the at least two additional configurable symbols.

6. The gaming device of claim 1, wherein the instructions, when executed, further cause the control system to, in response to the feature outcomes displaying at least a third additional configurable symbol, control the display system to animate a third award amount based on the second award amount and a second of the at least two additional configurable symbols.

7. The gaming device of claim 1, wherein the instructions, when executed, further cause the control system to, select and control the display system to animate replacement symbols for non-configurable symbols in a plurality of display symbol positions not occupied by the held configurable symbols.

8. The gaming device of claim 1, wherein the feature game symbol set comprises non-configurable symbols and configurable symbols.

9. The gaming device of claim 8, wherein the instructions further cause the control system to control the display system to initially display the configurable symbols in the feature game symbol set without showing their corresponding values and after the initial display, display their corresponding values.

10. The gaming device of claim 1, wherein the configurable symbols comprise a common component and a variable component, the variable component associated with a value.

11. The gaming device of claim 1, wherein the instructions further cause the control system to control the display system to randomly increasing values associated with the displayed configurable symbols.

12. The gaming device of claim 1, further comprising:

a credit input mechanism; and a payout mechanism, wherein the instructions further cause the control system to:

establish a credit balance in response to the credit input mechanism receiving a physical item representing a monetary value;

fund a wager amount funded by the credit balance and initiate play of a base game in response to input received via a player interface; and dispense a payout of the credit balance via the payout mechanism.

13. A method of conducting a game on a gaming device having a display device and a controller including a processor and memory storing a base game symbol set, a feature game symbol set comprising configurable symbols and non-configurable symbols, and instructions, which, when executed, cause the processor to initiate the game, the method comprising:

controlling the display device to animate, by the processor, a base game outcome having symbols selected from the base game symbol set based on a random number generated from a random number generator;

controlling the display device to animate, via the processor, a feature game having a first quantity of instances being played simultaneously, when the symbols selected comprise at least a quantity of trigger symbols; and controlling the display device to replicate the base game outcome that includes the quantity of trigger symbols in the first quantity of instances being played simultaneously;

controlling the display device to animate a plurality of feature outcomes for the first quantity of instances simultaneously having feature game symbols selected from the feature game symbol set;

controlling the display device to hold a displayed configurable symbol at a corresponding display symbol position for each of the first quantity of instances of the feature game being played simultaneously; and responsive to the feature outcomes displaying at least two additional configurable symbols, controlling the display device to animate a first award amount based on values of the configurable symbols held from previous instances, followed by a second award amount based on the first award amount and a first of the at least two additional configurable symbols.

14. The method of claim 13, further comprising, for a respective instance of the feature game:

determining that a respective feature outcome for the respective instance includes one configurable symbol; and based on determining that the respective feature outcome for the respective instance includes one additional configurable symbol, determining a third award amount based on values of the configurable symbols held from previous instances.

15. The method of claim 13, further comprising:

replacing the trigger symbols with configurable symbols prior to a presentation of the feature game; and holding each displayed configurable symbol at its corresponding display symbol position for all instances of the feature game.

16. The method of claim 13, further comprising when the feature outcomes displays at least a third additional configurable symbol, controlling the display device to animate a third award amount based on the second award amount and a second of the at least two additional configurable symbols.

17. One or more non-transitory media having a base game symbol set, a feature game symbol set comprising configurable symbols and non-configurable symbols, software stored thereon, the software including instructions for controlling one or more devices and a display device to perform the steps of:

animating on the display device a base game outcome having symbols selected from the base game symbol set;

animating on the display device a feature game having a first quantity of instances being played simultaneously, when the symbols selected comprise at least a quantity of trigger symbols; and replicating on the display device the base game outcome that includes the quantity of trigger symbols in the first quantity of instances being played simultaneously;

animating on the display device a plurality of feature outcomes for the first quantity of instances simultaneously having feature game symbols selected from the feature game symbol set;

holding a displayed configurable symbol at a corresponding display symbol position for each of the first quantity of instances of the feature game being played simultaneously; and in response to the feature outcomes displaying at least two additional configurable symbols, animating on the display device a first award amount based on values of the configurable symbols held from previous instances, followed by a second award amount based on the first award amount and a first of the at least two additional configurable symbols.

18. The one or more non-transitory media of claim 17, wherein the instructions, when executed, further control the one or more devices to perform the step of, for a respective instance of the feature game:

determining that a respective feature outcome for the respective instance includes one configurable symbol; and in response to determining that respective feature outcome for the respective instance includes one additional configurable symbol, determining a third award amount based on values of the configurable symbols held from previous instances.

19. The one or more non-transitory media of claim 17, wherein the instructions, when executed, further control the one or more devices to perform the steps of:

replacing the trigger symbols with configurable symbols prior to animating the feature game; and holding each displayed configurable symbol at its corresponding display symbol position for all instances of the feature game.

20. The one or more non-transitory media of claim 17, wherein the instructions, when executed, further control the one or more devices to perform the step of in response to the feature outcomes displays at least a third additional configurable symbol, animating on the display device a third award amount based on the second award amount and a second of the at least two additional configurable symbols.

* * * * *